US007419570B2

(12) United States Patent
Chen et al.

(10) Patent No.: US 7,419,570 B2
(45) Date of Patent: Sep. 2, 2008

(54) SOFT, STRONG CLOTHLIKE WEBS

(75) Inventors: Fung-Jou Chen, Appleton, WI (US); Jeffrey D. Lindsay, Appleton, WI (US); Thomas F. Hunt, Appleton, WI (US); Maurizio Tirimacco, Appleton, WI (US); John J. Urlaub, Oshkosh, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 813 days.

(21) Appl. No.: 10/305,792

(22) Filed: Nov. 27, 2002

(65) Prior Publication Data

US 2004/0099389 A1 May 27, 2004

(51) Int. Cl.
*D21H 23/56* (2006.01)

(52) U.S. Cl. ..... 162/134; 162/123; 162/135; 162/158; 162/124; 162/109; 162/111; 162/112; 428/195.1; 428/537.5

(58) Field of Classification Search ..... 162/134, 162/123, 135, 158, 124, 112, 113, 111, 109; 428/195.1, 537.5, 153, 156, 158, 171, 172
See application file for complete search history.

(56) References Cited

U.S. PATENT DOCUMENTS 2,666,369 A * 1/1954 Niks ..... 162/192
3,260,778 A 7/1966 Walton
3,696,183 A 10/1972 Steel et al.
3,708,565 A 1/1973 Seiffert
3,810,280 A 5/1974 Walton et al.
3,870,778 A 3/1975 Steel
3,879,257 A 4/1975 Gentile et al.
3,906,128 A 9/1975 Burling et al.
3,948,665 A 4/1976 Richter et al.
3,953,638 A 4/1976 Kemp (Continued)

FOREIGN PATENT DOCUMENTS

EP 1262243 A1 12/2002

(Continued)

OTHER PUBLICATIONS

Abstract of Japanese Publication 2000313082, Nov. 14, 2000.

(Continued)

*Primary Examiner*—Mark Halpern
(74) *Attorney, Agent, or Firm*—Dority & Manning, P.A.

(57) ABSTRACT

The present invention discloses a process and a method providing a high bulk tissue which is both strong and soft. Specifically, it has been discovered that certain low pressure printing technologies may be used to deliver a bonding material to the surface of a high bulk paper web such as an uncreped, through-dried web. The bonding material may be applied to the web either before, during or after the web is softened with a mechanical straining process which will decrease the web bulk by no more than 20% of the initial bulk in order to increase the web softness. The web may be softened by any of a variety of mechanical straining processes such as, for instance, microcreping, microstraining, rush transfer, or other low-compressive softening methods. The cured bonding material on the web may not only increase the bulk of the web when dry and wet, but also increase the wet resiliency and the wet strength of the web.

65 Claims, 13 Drawing Sheets

U.S. PATENT DOCUMENTS

| | | | |
|---|---|---|---|
| 3,976,820 | A | 8/1976 | Giovanelli et al. |
| 4,076,874 | A | 2/1978 | Giovanelli et al. |
| 4,143,890 | A | 3/1979 | Davis et al. |
| 4,181,762 | A | 1/1980 | Benedyk |
| 4,183,889 | A | 1/1980 | Brendel |
| 4,205,991 | A | 6/1980 | Becker et al. |
| 4,225,384 | A | 9/1980 | Valkama |
| 4,264,705 | A | 4/1981 | Allen |
| 4,309,179 | A | 1/1982 | Heuser et al. |
| 4,377,544 | A | 3/1983 | Rasmussen |
| 4,436,687 | A | 3/1984 | Bye et al. |
| 4,451,419 | A | 5/1984 | Bye et al. |
| 4,514,345 | A | 4/1985 | Johnson et al. |
| 4,517,278 | A | 5/1985 | Sakurai |
| 4,528,239 | A | 7/1985 | Trokhan |
| 4,578,504 | A | 3/1986 | Hammar |
| 4,637,859 | A | 1/1987 | Trokhan |
| 4,786,657 | A | 11/1988 | Hammar et al. |
| 4,919,877 | A | 4/1990 | Parsons et al. |
| 4,921,643 | A | 5/1990 | Walton et al. |
| 5,015,556 | A | 5/1991 | Martens |
| 5,019,211 | A | 5/1991 | Sauer |
| 5,048,589 | A | 9/1991 | Cook et al. |
| 5,098,522 | A | 3/1992 | Smurkoski et al. |
| 5,120,360 | A | 6/1992 | Tajiri et al. |
| 5,175,072 | A | 12/1992 | Martens |
| 5,187,044 | A | 2/1993 | Prioleau et al. |
| 5,215,859 | A | 6/1993 | Martens |
| 5,279,697 | A | 1/1994 | Peterson et al. |
| 5,322,761 | A | 6/1994 | Kausch et al. |
| 5,334,289 | A | 8/1994 | Trokhan et al. |
| 5,399,412 | A | 3/1995 | Sudall et al. |
| 5,429,686 | A | 7/1995 | Chiu et al. |
| 5,462,835 | A | 10/1995 | Mirle et al. |
| 5,558,020 | A | 9/1996 | Marozzi et al. |
| 5,562,645 | A | 10/1996 | Tanzer et al. |
| 5,565,255 | A | 10/1996 | Young et al. |
| 5,607,760 | A | 3/1997 | Roe |
| 5,609,587 | A | 3/1997 | Roe |
| 5,656,132 | A | 8/1997 | Farrington, Jr. et al. |
| 5,670,110 | A | 9/1997 | Dirk et al. |
| 5,743,999 | A | 4/1998 | Kamps et al. |
| 5,772,845 | A | 6/1998 | Farrington, Jr. et al. |
| 5,798,202 | A | 8/1998 | Cushner et al. |
| 5,858,554 | A | 1/1999 | Neal et al. |
| 5,885,697 | A | 3/1999 | Krzyski et al. |
| 5,904,811 | A | 5/1999 | Ampulski et al. |
| 5,916,732 | A | 6/1999 | Sasashita et al. |
| 5,976,763 | A | 11/1999 | Roberts et al. |
| 5,990,377 | A | 11/1999 | Chen et al. |
| 6,017,417 | A | 1/2000 | Wendt et al. |
| 6,043,317 | A | 3/2000 | Mumick et al. |
| 6,096,412 | A | 8/2000 | McFarland et al. |
| 6,103,061 | A | 8/2000 | Anderson et al. |
| 6,103,062 | A | 8/2000 | Ampulski et al. |
| 6,126,784 | A | 10/2000 | Ficke et al. |
| 6,129,815 | A * | 10/2000 | Larson et al. ..... 162/112 |
| 6,187,137 | B1 | 2/2001 | Druecke et al. |
| 6,197,459 | B1 | 3/2001 | Leach |
| 6,197,479 | B1 | 3/2001 | Tanaka et al. |
| 6,214,274 | B1 | 4/2001 | Melius et al. |
| 6,231,719 | B1 | 5/2001 | Garvey et al. |
| 6,248,212 | B1 | 6/2001 | Anderson et al. |
| 6,287,581 | B1 | 9/2001 | Krzysik et al. |
| 6,322,665 | B1 | 11/2001 | Sun et al. |
| 6,395,957 | B1 | 5/2002 | Chen et al. |
| 6,410,097 | B2 | 6/2002 | Kume et al. |
| 6,423,180 | B1 | 7/2002 | Behnke et al. |
| 6,429,261 | B1 | 8/2002 | Lang et al. |
| 6,436,234 | B1 | 8/2002 | Chen et al. |
| 6,447,643 | B2 | 9/2002 | Fingal et al. |
| 6,500,289 | B2 | 12/2002 | Merker et al. |
| 6,841,590 | B2 | 1/2005 | Modi et al. |
| 2002/0180092 | A1 | 12/2002 | Abba et al. |

FOREIGN PATENT DOCUMENTS

| | | | |
|---|---|---|---|
| EP | 1262531 | A1 | 12/2002 |
| GB | 1378638 | | 12/1974 |
| WO | WO 9711226 | A1 | 3/1997 |
| WO | WO 9718784 | A1 | 5/1997 |
| WO | WO 9920822 | A1 | 4/1999 |
| WO | WO 0020682 | A1 | 4/2000 |
| WO | WO 0030582 | A1 | 6/2000 |
| WO | WO 0048544 | A1 | 8/2000 |
| WO | WO 0071334 | A1 | 11/2000 |
| WO | WO 0119306 | A1 | 3/2001 |
| WO | WO 0120079 | A1 | 3/2001 |
| WO | WO 0126592 | A1 | 4/2001 |
| WO | WO 0126595 | A1 | 4/2001 |
| WO | WO 0131123 | A1 | 5/2001 |
| WO | WO 0147700 | A1 | 7/2001 |
| WO | WO 02081819 | A1 | 10/2002 |
| WO | WO 02098571 | A2 | 12/2002 |
| WO | WO 02098999 | A2 | 12/2002 |
| WO | WO 03057965 | A1 | 7/2003 |

OTHER PUBLICATIONS

Abstract of Article entitled "Vivelle" by C. Knight, UMIST Non-woven Conference, Paper No. 16, Jun. 1983, pp. 353-362.
PCT Search Report for PCT/US03/38064, Jun. 7, 2004.
PCT Search Report for PCT/US03/27316, May 4, 2004.
Fung-Jou Chen et al., U.S. Appl. No. 10/305,791, filed Nov. 27, 2002, Structural Printing Of Absorbent Webs.
Fung-Jou Chen et al., U.S. Appl. No. 10/329,991, filed Dec. 26, 2002, Absorbent Webs Including Highly Textured Surfaces.

* cited by examiner

Physical Properties from Latex Printing Trials

| Sample Description | No. Sides Printed | CD Wet/Dry % | MD Dry Tensile | | CD Dry Tensile | | CD Wet Tensile | | Caliper,in. |
|---|---|---|---|---|---|---|---|---|---|
| | | | g/3"x4" | % Stretch | g/3"x4" | % Stretch | g/3"x4" | % Stretch | 0.289 psi |
| Control 1: Off Roll | 0 | 12 | 592.7 | 22.0 | 464.7 | 8.2 | 56.2 | 4.5 | 0.0283 |
| Control 2: Through Process | 0 | 12 | 585.1 | 18.4 | 453.2 | 8.5 | 56.2 | 4.6 | 0.0282 |
| 0.006" Gap | 1 | 15 | 601.6 | 16.7 | 434.1 | 8.2 | 63.0 | 4.5 | 0.0295 |
| 0.008" Gap | 1 | 15 | 585.5 | 19.8 | 489.3 | 7.6 | 73.6 | 5.1 | 0.0293 |
| 0.008" Gap, Higher Add-On | 1 | 14 | 606.0 | 20.9 | 475.8 | 8.1 | 68.1 | 4.3 | 0.0272 |
| 0.010" Gap | 1 | 13 | 576.8 | 19.2 | 485.8 | 7.8 | 64.7 | 4.4 | 0.0286 |
| 0.002" Gap | 2 | 24 | 1253.9 | 17.3 | 929.5 | 10.8 | 222.9 | 9.2 | 0.0232 |
| 0.004" Gap | 2 | 26 | 1064.1 | 24.3 | 758.8 | 9.8 | 196.6 | 9.0 | 0.0289 |
| 0.008" Gap | 2 | 16 | 695.1 | 23.3 | 610.5 | 8.8 | 99.7 | 6.8 | 0.0301 |

FIG. 12

SOFT, STRONG CLOTHLIKE WEBS

BACKGROUND OF THE INVENTION

Products made from paper webs such as bath tissues, facial tissues, paper towels, industrial wipers, food service wipers, napkins, medical pads and other similar products are designed to include several important properties. For example, the product should have a relatively soft feel, should be strong, and, for most applications, should be highly absorbent. High bulk is also often preferred in such products. For example, three dimensional, high bulk paper products are often preferred over thinner, more two-dimensional products.

Several methods have been proposed in the past for producing a high bulk paper product which is both soft and strong. These methods still present difficulties to be overcome, however, due to the fact that the two desired characteristics tend to be mutually exclusive. For example, the cost of increasing product strength is often a decrease in product softness. The reverse is also true, processes which may increase softness, such as addition of debonding agents to the fiber slurry or creping, tend to decrease product strength. Similarly, processes which may increase web strength usually involve an increase in the number of interfiber bonds and are often accompanied with increase in web density. Such strengthening processes may not only decrease product softness but also decrease product bulk.

A creping method to make both a strong and soft towel is disclosed in U.S. Pat. No. 3,879,257, issued to Gentile, et al., entitled "Absorbent Unitary Laminate-Like Fibrous Webs and Method for Producing Them." Gentile, et al. discloses a process of creping a base sheet, printing a bonding material on one side of the base sheet, creping the base sheet again, printing a bonding material on the other side of the base sheet, and then creping the base sheet a third time. In particular, the base sheet is printed while traveling through gravure nip rolls. During the process, referred to as the Double Recrepe (DRC) process, the gravure print process compresses the base sheet to less than 50% of its incoming caliper as it prints the bonding material onto the sheet. The DRC process provides a web possessing a good combination of strength and softness, but the process of having, successively, three pressings does not provide a particularly bulky sheet.

More recently, through-drying has become an alternate means of drying paper webs. Through-drying provides a relatively noncompressive method of removing water from the web by passing hot air through the web until it is dry. More specifically, a wet-laid web is transferred from a forming fabric to a coarse, highly permeable throughdrying fabric and retained on the throughdrying fabric until fairly dry. The resulting through-dried web is bulkier than a conventionally dried and creped sheet because the web is less compressed. Squeezing water from the wet web is eliminated, although the use of a pressure roll to subsequently transfer the web to a Yankee dryer for creping may still be used.

While there is a processing incentive to eliminate the Yankee dryer and make an uncreped throughdried product, uncreped throughdried sheets are typically stiff and rough to the touch, compared to their creped counterparts. This is partially due to the inherently high stiffness and strength of an uncreped sheet, but may also in part be due to the coarseness of the throughdrying fabric onto which the wet web is conformed and dried. Softening processes, such as calendering or creping, while increasing product softness, will also increase density of the through-dried sheet, and decrease desired product bulk.

Accordingly, there is a need for a paper product, or paper sheet, that is soft, absorbent and strong, and more particularly, which has higher bulk than those products made conventionally using an uncreped through-dried process or a double recreped process.

SUMMARY OF THE INVENTION

The present invention is directed to a process for adding additional softness and strength to a high bulk paper web, for example, a paper web having a bulk greater than about 10 cc/g. The present invention is also directed to the products produced by the process. In one embodiment, the paper web may be formed with a bulk of between about 10 cc/g and about 20 cc/g. For example, the high bulk paper web may be an uncreped, through-dried paper web.

In general, strength may be increased in the web through addition of a bonding material in a pattern onto a surface of a web. In particular, the bonding material may be printed onto the surface of the web with a process which does not substantially densify the web fibers, and as such does not substantially decrease web bulk. For example, the bonding material may be applied to the web at a peak pressure of less than about 100 psi, more specifically between about 0.2 and about 30 psi, most specifically about 5 psi or less. In one embodiment, the bonding material may be added to the web by use of a low pressure printing process, for example a flexographic printing process, an inkjet printing process, or a digital printing process.

To suitably increase strength of the web, the bonding material may be printed onto the web in a pattern on a surface of the web. In one embodiment, the bonding material printed onto the surface of the web in a pattern may cover about 10 to about 90% of the total web surface. In one embodiment, the pattern may be essentially continuous across the web surface.

The printed bonding material may be cured after printing. The term "curing," as used herein, can refer to any process which converts a printable material into a substantial solid form effective for bonding a web. Curing can comprise, for example, cooling the bonding material (e.g., a thermoplastic that cools and solidifies after printing), heating the bonding material (e.g., a thermoset resin or other compound that crosslinks at elevated temperature), drying the bonding material (e.g., removing water from a latex compound), applying radiation or other forms or energy to the bonding material (e.g., applying actinic radiation or other forms of light to a photocurable polymer), applying a chemical agent such as a catalyst or water vapor to a bonding material to drive a crosslinking reaction, allowing time for a reaction to occur (e.g., an epoxy in which reactive components have already been mixed prior to printing on the web), and the like.

In addition to added strength due to the presence of the bonding material, the high bulk paper web of the present invention may have increased softness characteristics through subjection to a low-compressive softening process which mechanically strains the web. In particular, the mechanical straining process will decrease web bulk by no more than 20% of the initial, pre-softened bulk value.

In one embodiment, the web may be flexographically printed with the bonding material in a printing nip which is formed between two interdigitating rolls. If desired, the web may be microstrained in the interdigitating nip at the same time as the bonding material is printed on to the web. Other methods may be used either alone or in conjunction with a flexographic nip to print the bonding material on the web as well as to mechanically strain and soften the web, however.

For example, in certain embodiments the web may be softened with a process including mirocreping, rush transfer, brushing, or ring rolling processes.

The order of the softening and strengthening processes is not critical to the present invention. For example, the web may be subjected to mechanical straining prior to addition of the bonding material, subsequent to the addition of the bonding material, or even at essentially the same time.

The bonding material may be any suitable bonding material that may be applied to the web using the low-pressure printing process. Examples include known hot melts, silicone bonding materials, latex compounds, and other curable bonding materials including structural bonding materials (epoxies, urethanes, etc.), UV-curable bonding materials, and the like. In some embodiments, the bonding materials may be non-pressure sensitive adhesives (non-PSA).

Conventional flexographic inks for printing on paper typically have low viscosity, such as a viscosity of about 2 poise or less measured with a Brookfield viscometer at 20 revolutions per minute, or about 1 poise at infinite shear as determined by Casson plot. More viscous inks are known for use on textiles, wherein the inks may have viscosities of about 10-65 poise at 20 RPM on a Brookfield viscometer and about 3 to 15 poise at infinite shear as determined by Casson plot. Higher viscosity inks and pastes have also been disclosed for flexographic printing on textiles. However, according to the present invention, bonding material having still higher viscosities may be printed with flexographic means on an absorbent web.

For example, at the temperature of application, a hot melt applied to a tissue or airlaid web with flexographic means may have a viscosity measured at 20 rpm on a Brookfield viscometer of 20 poise (p) or greater, such as 30 p, 50 p, 100 p, 200 p, 500 p, 1,000 p, 5,000 p, 10,000 p, 20,000 p, or greater. At infinite shear as measured using a Casson plot, the apparent viscosity of the viscous bonding material of the present invention may be, for example, 300 p, 800 p, 3,000 p, 8,000 p, 15,000 p, or greater. The viscosity values may apply to the hotmelt at the pool temperature (the temperature of the hotmelt immediately before it is applied to the flexographic cylinder), or may refer to viscosities measured at 150° C. Alternatively, hot melt bonding materials for use in the present invention may have a viscosity evaluated at 195° C. of 1 poise to 300 poise (100 cp to 30,000 cp), more specifically from about 10 poise to 200 poise, and most specifically from about 20 poise to about 100 poise.

At room temperature, the viscous bonding materials may behave as a solid. The melting point of the viscous bonding material for use in the present invention may be, for example, 40° C., 60° C., 80° C., 100° C., 120° C., 150° C., 200° C., 250° C., 300° C., or greater. In certain embodiments, the melting point of the bonding material may be from about 40° C. to about 200° C., more specifically from about 60° C. to about 150° C., and most specifically from about 60° C. to about 120° C.

Suitable hotmelts may include, but are not limited to, EVA (ethylene vinyl acetate) hot melts (e.g. copolymers of EVA), polyolefin hotmelts, polyamide hotmelts, pressure sensitive hot melts, styrene-isoprene-styrene (SIS) copolymers, styrene-butadiene-styrene (SBS) copolymers, ethylene ethyl acrylate copolymers (EEA), polyurethane reactive (PUR) hotmelts, and the like. In one embodiment, poly(alkyloxazoline) hotmelt compounds may be used. If desired, the hotmelt may be water sensitive or water-remoistenable. This may be desirable, for example, in an embodiment wherein the applied hotmelt may be moistened and then joined to another surface to bond the printed web to the other surface.

If a latex or other bonding material other than hotmelts is used, the viscosity as applied (prior to drying or curing) may be greater than 65 cp, specifically about 100 cp or greater, more specifically about 200 cp or greater, more specifically still about 250 cp or greater, such as from about 150 cp to about 500 cp, or from about 200 cp to about 1000 cp, or from about 260 cps to about 5000 cp. Solids content of a latex may be about 10% or greater, specifically about 25% or greater, more specifically about 35% or greater, and most specifically about 45% or greater.

In one embodiment, the bonding material may be printed on both sides of the paper web. For instance, the bonding material may be printed on the second side of the web in a pattern which is the same or different from the first pattern. Additionally, other additives may be printed or otherwise added to the web on either the first or second surface of the web, as long as the additives are added in such a manner so as not to substantially densify the web.

The strong, soft, high bulk paper webs produced by the process of the present invention may generally have a basis weight of between about 10 and about 200 gsm, specifically between about 15 and 120 gsm, more specifically between about 25 and 100 gsm, most specifically between about 30 an 90 gsm. The web may have a bulk greater than about 7 cc/g after processing according to the present invention. In one embodiment, the web may have a bulk between about 10 and about 20 cc/g. The Frazier air permeability of the base web may generally be greater than about 10 CFM. In one embodiment, the paper web may be a stratified web. If desired, the web may be a multi-ply web with individual plies essentially the same or different.

DEFINITIONS AND TEST METHODS

As used herein, a material is said to be "absorbent" if it may retain an amount of water equal to at least 100% of its dry weight as measured by the test for Intrinsic Absorbent Capacity given below (i.e., the material has an Intrinsic Absorbent Capacity of about 1 or greater). For example, the absorbent materials used in the absorbent products of the present invention may have an Intrinsic Absorbent Capacity of about 2 or greater, more specifically about 4 or greater, more specifically still about 7 or greater, and more specifically still about 10 or greater, with exemplary ranges of from about 3 to about 30 or from about 4 to about 25 or from about 12 to about 40.

As used herein, "Intrinsic Absorbent Capacity" refers to the amount of water that a saturated sample may hold relative to the dry weight of the sample and is reported as a dimensionless number (mass divided by mass). The test is performed according to Federal Government Specification UU-T-595b. It is made by cutting a 10.16 cm long by 10.16 cm wide (4 inch long by 4 inch wide) test sample, weighing it, and then saturating it with water for three minutes by soaking. The sample is then removed from the water and hung by one corner for 30 seconds to allow excess water to be drained off. The sample is then re-weighed, and the difference between the wet and dry weights is the water pickup of the sample expressed in grams per 10.16 cm long by 10.16 cm wide sample. The Intrinsic Absorbent Capacity value is obtained by dividing the total water pick-up by the dry weight of the sample. If the material lacks adequate integrity when wet to perform the test without sample disintegration, the test method may be modified to provide improved integrity to the sample without substantially modifying its absorbent properties. Specifically, the material may be reinforced with up to 6 lines of hot melt bonding material having a diameter of about 1 mm applied to the outer surface of the article to encircle the material with a water-resistant band. The hot melt should be applied to avoid penetration of the bonding material into the body of the material being tested. The corner on which the sample is hung in particular should be reinforced with external hot melt bonding material to increase integrity if the untreated sample cannot be hung for 30 seconds when wet.

As used herein, "bulk" and "density," unless otherwise specified, are based on an oven-dry mass of a sample and a thickness measurement made at a load of 0.34 kPa (0.05 psi) with a 7.62-cm (three-inch) diameter circular platen. Details for thickness measurements and other forms of bulk are described hereafter.

For macroscopic thickness measurement to give an overall thickness of the sheet for use in calculating the "bulk" of the web, as used herein, the thickness measurement is conducted on a stack of five sheets at a load of 0.05 psi using a three-inch diameter circular platen to apply the load. Samples are measured after conditioned for four hours in a TAPPI-conditioned room. The sheets rest beneath the flat platen and above a flat surface parallel to the platen. The platen is connected to a thickness gauge such as a Mitutoyo digital gauge which senses the displacement of the platen caused by the presence of the sheets. Samples should be essentially flat and uniform under the contacting platen. Bulk is calculated by dividing the thickness of five sheets by the basis weight of the five sheets (conditioned mass of the stack of five sheets divided by the area occupied by the stack, which is the area of a single sheet). Bulk is expressed as volume per unit mass in cc/g and density is the inverse, g/cc.

"Brookfield viscosity" may be measured with a Brookfield Digital Rheometer Movel DV-III with a Brookfield Temperature Controller using Spindle #27.

A measure of the permeability of a fabric or web to air is the "Frazier Permeability" or "Air Permeability" which is performed according to Federal Test Standard 191A, Method 5450, dated Jul. 20, 1978, and is reported as an average of 3 sample readings. Frazier Permeability measures the airflow rate through a web in cubic feet of air per square foot of web per minute or CFM.

A three-dimensional basesheet or web is a sheet with significant variation in surface elevation due to the intrinsic structure of the sheet itself. As used herein, this elevation difference is expressed as the "Surface Depth."

BRIEF DESCRIPTION OF THE FIGURES

A full and enabling disclosure of the present invention, including the best mode thereof to one of ordinary skill in the art, is set forth more particularly in the remainder of the specification, including reference to the accompanying figures in which:

FIG. 12 provides a table of experimental data.

Figure 1:
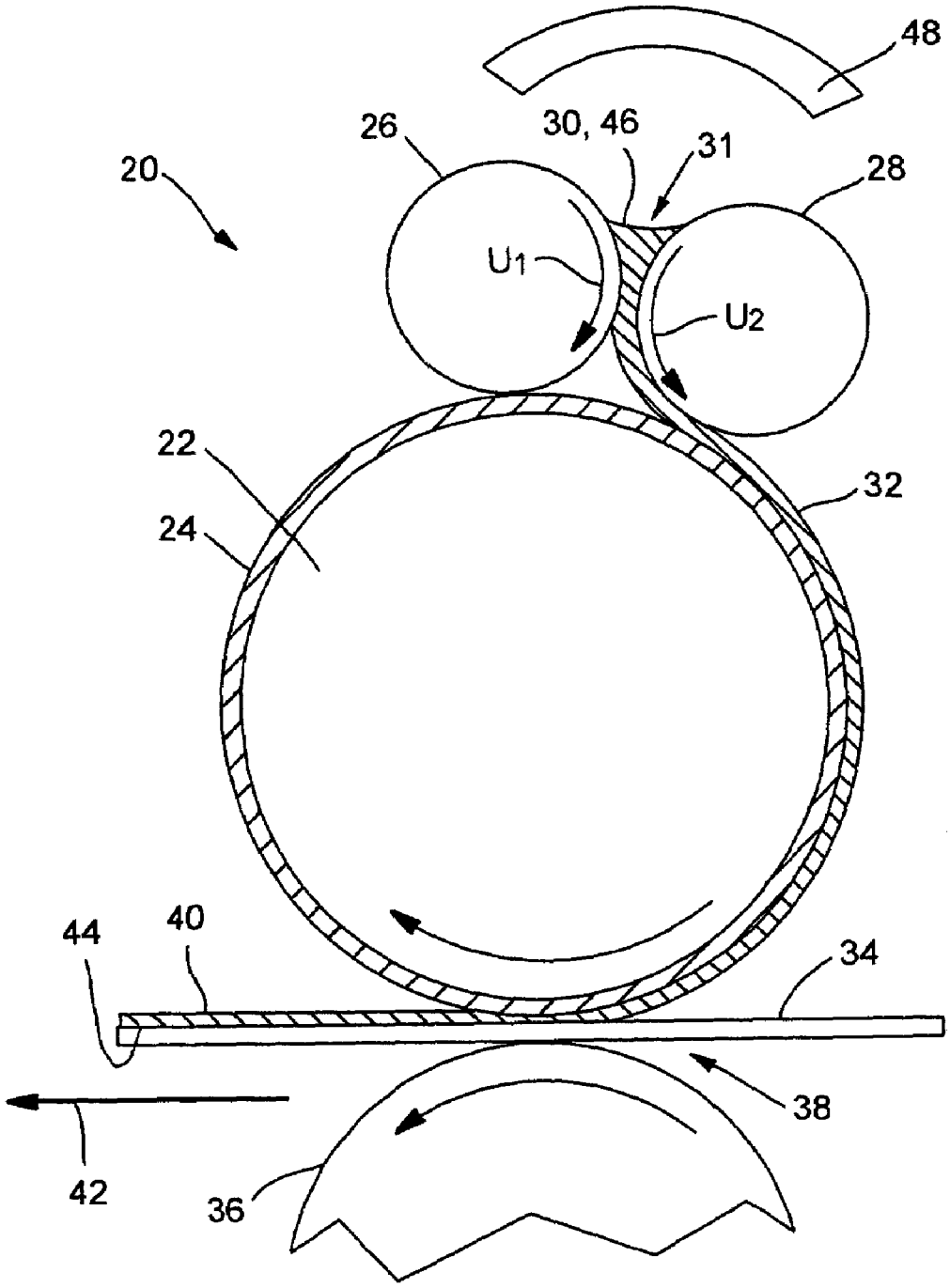
FIG. 1 depicts one embodiment of a flexographic printing apparatus suitable for use in the process of the present invention.

Repeat use of reference characters in the present specification and drawings is intended to represent same or analogous features or elements of the present invention.

DETAILED DESCRIPTION OF PREFERRED EMBODIMENTS

Reference now will be made in detail to embodiments of the invention, one or more examples of which are set forth below. Each example is provided by way of explanation of the invention, not limitation of the invention. In fact, it will be apparent to those skilled in the art that various modifications and variations may be made in the present invention without departing from the scope or spirit of the invention. For instance, features illustrated or described as part of one embodiment, may be used on another embodiment to yield a still further embodiment. Thus, it is intended that the present invention cover such modifications and variations as come within the scope of the appended claims and their equivalents.

The present invention is generally directed to a process for producing an improved high bulk paper web and the high bulk webs produced by the process. In one embodiment, the process of the present invention provides a method for producing high bulk, uncreped, through air-dried (UCTAD) paper products which are both strong and soft. Specifically, it has been discovered that a high bulk web, such as an UCTAD web, may be strengthened through application of bonding materials to the web surface using certain printing technologies which do not cause substantial fiber densification in the web and the attendant loss in product bulk. In conjunction with strengthening the UCTAD web, the web may be softened using mechanical straining processes which may mechanically decrease interfiber bonds within the web without substantial loss of bulk.

Advantageously, the web may be subjected to the strengthening process and the softening process of the present invention in either order, allowing for a process design which may maximize efficiency while minimizing associated costs. For instance, the web may be subjected to the softening process and then, at some later time, may be subjected to the strengthening process. If preferred, however, the strengthening process may be completed prior to the softening process. In one embodiment, bonding material may be applied for strengthening the web at essentially the same time as the web is softened in order to produce the strong, soft webs of the present invention in a one-step process.

In one embodiment, the pattern of the bonding material on the web may be such that the presence of the cured bonding material may not only strengthen the web, but may also increase retention of added bulk in the web when both wet and dry, for example, such as when the web has been molded to a more three dimensional structure. The present process may also increase the wet resiliency, the wet strength as well as improve the tactile properties of the paper products. In one embodiment, the treated web may maintain its high bulk even when wet and under a compressive load, whereas without the applied bonding material, the web would be relatively flatter and would have a decreased bulk, particularly when under load and/or wet.

The bonding material may be printed on one or both sides of the web, as desired. When printed on both sides of the web, the bonding material may be printed in the same or different patterns on each side. When the same pattern is used on both sides of the web, the patterns may be alternatively aligned with each other or may be staggered.

Base webs that may be used in the process of the present invention may vary depending upon the particular application. In general, any suitable high bulk base web may be used in the process in order to improve the characteristics of the web. Further, the webs may be made from any suitable type of papermaking fibers.

"Papermaking fibers," as used herein, include all known cellulosic fibers or fiber mixes comprising cellulosic fibers. As used herein, the term "cellulosic" is meant to include any material having cellulose as a major constituent, and specifically comprising at least 50 percent by weight cellulose or a cellulose derivative. Thus, the term includes cotton, typical wood pulps, nonwoody cellulosic fibers, cellulose acetate, cellulose triacetate, rayon, thermomechanical wood pulp, chemical wood pulp, debonded chemical wood pulp, milkweed, or bacterial cellulose.

Fibers suitable for making the webs of this invention may include any natural or synthetic cellulosic fibers including, but not limited to nonwoody fibers, such as cotton, abaca, kenaf, sabai grass, flax, esparto grass, straw, jute hemp, bagasse, milkweed floss fibers, and pineapple leaf fibers; and woody fibers such as those obtained from deciduous and coniferous trees, including softwood fibers, such as northern and southern softwood kraft fibers; hardwood fibers, such as eucalyptus, maple, birch, and aspen. Woody fibers may be prepared in high-yield or low-yield forms and may be pulped in any known method, including kraft, sulfite, high-yield pulping methods and other known pulping methods. Fibers prepared from organosolv pulping methods may also be used. Useful fibers may also be produced by anthraquinone pulping. A portion of the fibers, such as up to 50% or less by dry weight, or from about 5% to about 30% by dry weight, may be synthetic fibers such as rayon, polyolefin fibers, polyester fibers, bicomponent sheath-core fibers, and the like. An exemplary polyethylene fiber is Pulpexe®, available from Hercules, Inc. (Wilmington, Del.).

Synthetic cellulose fiber types include rayon in all its varieties and other fibers derived from viscose or chemically modified cellulose. Chemically treated natural cellulosic fibers may be used such as mercerized pulps, chemically stiffened or crosslinked fibers, or sulfonated fibers. For good mechanical properties in using papermaking fibers, it may be desirable that the fibers be relatively undamaged and largely unrefined or only lightly refined. While recycled fibers may be used, virgin fibers are generally useful for their mechanical properties and lack of contaminants. Mercerized fibers, regenerated cellulosic fibers, cellulose produced by microbes, rayon, and other cellulosic material or cellulosic derivatives may be used. Suitable papermaking fibers may also include recycled fibers, virgin fibers, or mixes thereof. In certain embodiments capable of high bulk and good compressive properties, the fibers may have a Canadian Standard Freeness of at least 200, more specifically at least 300, more specifically still at least 400, and most specifically at least 500.

As used herein, "high yield pulp fibers" are those papermaking fibers of pulps produced by pulping processes providing a yield of about 65 percent or greater, more specifically about 75 percent or greater, and still more specifically from about 75 to about 95 percent. Yield is the resulting amount of processed fiber expressed as a percentage of the initial wood mass. High yield pulps include bleached chemithermomechanical pulp (BCTMP), chemithermomechanical pulp (CTMP), pressure/pressure thermomechanical pulp (PTMP), thermomechanical pulp (TMP), thermomechanical chemical pulp (TMCP), high yield sulfite pulps, and high yield Kraft pulps, all of which contain fibers having high levels of lignin. Characteristic high-yield fibers may have lignin content by mass of about 1% or greater, more specifically about 3% or greater, and still more specifically from about 2% to about 25%. Likewise, high yield fibers may have a kappa number greater than 20, for example. In one embodiment, the high-yield fibers are predominately softwood, such as northern softwood or, more specifically, northern softwood BCTMP. The amount of high-yield pulp fibers present in the sheet may vary depending upon the particular application. For instance, the high-yield pulp fibers may be present in an amount of about 5 dry weight percent or greater, or specifically, about 15 dry weight percent or greater, and still more specifically from about 15 to about 30%. In other embodiments, the percentage of high-yield fibers in the web may be greater than any of the following: about 30%, about 50%, about 60%, about 70%, and about 90%. For example, the web may comprise about 100% high-yield fibers.

In one embodiment, the web may be a multi-ply paper web product. For example, a laminate of two or more tissue layers or a laminate of an airlaid web and a wet laid tissue may be formed using bonding materials or other means known in the art.

The paper web of the present invention may optionally be formed with other known paper making additives which may be utilized to improve the web characteristics. For example, paper webs formed with surfactants, softening agents, permanent and/or temporary wet strength agents, or dry strength agents are all suitable for use in the present inventive process.

As used herein, the term "surfactant" includes a single surfactant or a mixture of two or more surfactants. If a mixture of two or more surfactants is employed, the surfactants may be selected from the same or different classes, provided only that the surfactants present in the mixture are compatible with each other. In general, the surfactant may be any surfactant known to those having ordinary skill in the art, including anionic, cationic, nonionic and amphoteric surfactants. Examples of anionic surfactants include, among others, linear and branched-chain sodium alkylbenzenesulfonates; linear and branched-chain alkyl sulfates; linear and branched-chain alkyl ethoxy sulfates; and silicone phosphate esters, silicone sulfates, and silicone carboxylates such as those manufactured by Lambent Technologies, located in Norcross, Ga. Cationic surfactants include, by way of illustration, tallow trimethylammonium chloride and, more generally, silicone amides, silicone amido quaternary amines, and silicone imidazoline quaternary amines. Examples of nonionic surfactants, include, again by way of illustration only, alkyl polyethoxylates; polyethoxylated alkylphenols; fatty acid ethanol amides; dimethicone copolyol esters, dimethiconol esters, and dimethicone copolyols such as those manufactured by Lambent Technologies; and complex polymers of ethylene oxide, propylene oxide, and alcohols. One exemplary class of amphoteric surfactants is the silicone amphoterics manufactured by Lambent Technologies (Norcross, Ga.).

Softening agents, sometimes referred to as debonders, may be used in the present invention to enhance the softness of the tissue product. Softening agents may be incorporated with the fibers before, during or after disperging. Such agents may also be sprayed, printed, or coated onto the web after formation, while wet, or added to the wet end of the tissue machine prior to formation. Suitable agents include, without limitation, fatty acids, waxes, quaternary ammonium salts, dimethyl dihydrogenated tallow ammonium chloride, quaternary ammonium methyl sulfate, carboxylated polyethylene, cocamide diethanol amine, coco betaine, sodium lauryl sarcosinate, partly ethoxylated quaternary ammonium salt, distearyl dimethyl ammonium chloride, polysiloxanes and the like. Examples of suitable commercially available chemical softening agents include, without limitation, Berocell 596 and 584 (quaternary ammonium compounds) manufactured by Eka Nobel Inc., Adogen 442 (dimethyl dihydrogenated tallow ammonium chloride) manufactured by Sherex Chemical Company, Quasoft 203 (quaternary ammonium salt) manufactured by Quaker Chemical Company, and Arquad 2HT-75 (dihydrogenated tallow) dimethyl ammonium chloride) manufactured by Akzo Chemical Company. Suitable amounts of softening agents will vary greatly with the species selected and the desired results. Such amounts may be, without limitation, from about 0.05 to about 1 weight percent based on the weight of fiber, more specifically from about 0.25 to about 0.75 weight percent, and still more specifically about 0.5 weight percent.

Typically, the means by which fibers are held together in paper and tissue products involve hydrogen bonds and sometimes combinations of hydrogen bonds and covalent and/or ionic bonds. In the present invention, it may be useful to provide a material that will allow bonding of fibers in such a way as to immobilize the fiber-to-fiber bond points and make them resistant to disruption in the wet state. In this instance, the wet state usually will mean when the product is largely saturated with water or other aqueous solutions, but could also mean significant saturation with body fluids such as urine, blood, mucus, menses, runny bowel movement, lymph and other body exudates.

There are a number of materials commonly used in the paper industry to impart wet strength to paper and board that are applicable to this invention. These materials are known in the art as "wet strength agents" and are commercially available from a wide variety of sources. Any material that when added to a paper web or sheet results in providing the sheet with a mean wet geometric tensile strength:dry geometric tensile strength ratio in excess of 0.1 will, for purposes of this invention, be termed a wet strength agent. Typically these materials are termed either as permanent wet strength agents or as "temporary" wet strength agents. For the purposes of differentiating permanent from temporary wet strength, permanent will be defined as those resins which, when incorporated into paper or tissue products, will provide a product that retains more than 50% of its original wet strength after exposure to water for a period of at least five minutes. Temporary wet strength agents are those which show less than 50% of their original wet strength after being saturated with water for five minutes. Both classes of material find application in the present invention. The amount of wet strength agent added to the pulp fibers may be at least about 0.1 dry weight percent, more specifically about 0.2 dry weight percent or greater, and still more specifically from about 0.1 to about 3 dry weight percent, based on the dry weight of the fibers.

Permanent wet strength agents will provide a more or less long-term wet strength to the product. In contrast, the temporary wet strength agents could provide products that had low density and high resilience, but would not provide products that had long-term resistance to exposure to water or body fluids. The mechanism by which the wet strength is generated has little influence on the products of this invention as long as the essential property of generating water-resistant bonding at the fiber/fiber bond points is obtained.

Suitable permanent wet strength agents are typically water soluble, cationic oligomeric or polymeric resins that are capable of either crosslinking with themselves (homocrosslinking) or with the cellulose or other constituent of the wood fiber. The most widely used materials for this purpose are the class of polymer known as polyamide-polyamine-epichlorohydrin type resins.

With respect to the classes and the types of wet strength resins listed, it should be understood that this listing is simply to provide examples and that this is neither meant to exclude other types of wet strength resins, nor is it meant to limit the scope of this invention.

Although wet strength agents as described may be used in connection with this invention, other agents may also be used to provide wet resiliency. They may be applied at the wet end of the basesheet manufacturing process or applied by spraying or printing after the basesheet is formed or after it is dried.

In general, the process of the present invention includes forming a high bulk paper web. In one embodiment, high bulk paper webs may be prepared using through-drying methods as are known in the art. For example, referring to FIG. 9, an embodiment for forming a base web for use in the process of the present invention containing a through-air dryer is illustrated. As shown, a dilute aqueous suspension of fibers is supplied by a headbox 10 and deposited via a sluice 11 in uniform dispersion onto a forming fabric 12 in order to form a base web 34.

Once deposited onto the forming fabric 12, water is removed from the web 34 by combinations of gravity, centrifugal force and vacuum suction depending upon the forming configuration. As shown in this embodiment, a vacuum box 13 may be disposed beneath the forming fabric 12 for removing water and facilitating formation of the web 34.

Figure 9:
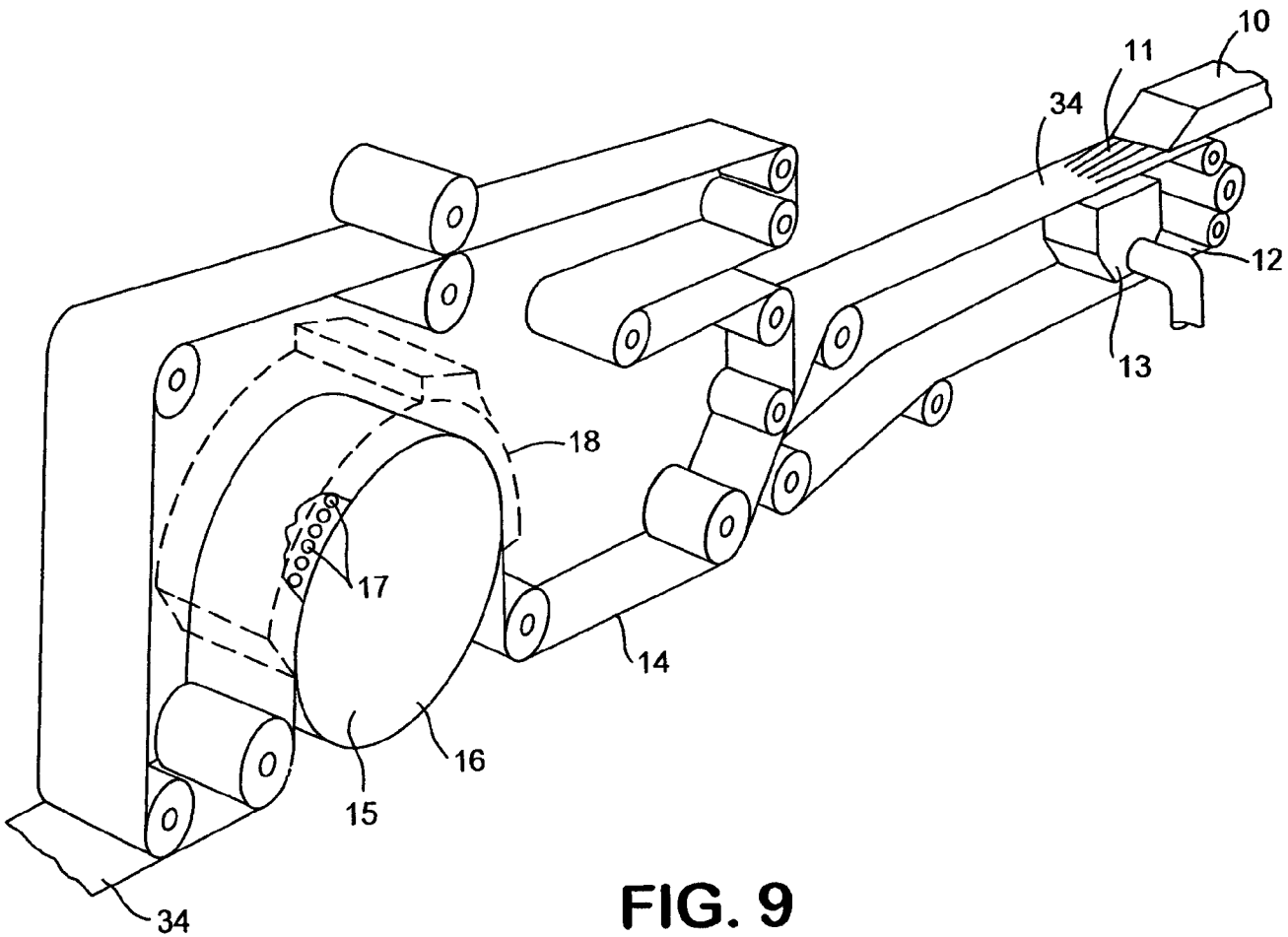
FIG. 9 is a perspective view with cut away portions of a fibrous web-forming machine that includes a through-air dryer for removing moisture from the web.

From the forming fabric 12, the base web 34 is then transferred to a second fabric 14. The second fabric 14 carries the web through a through-air drying apparatus 15. The through-air dryer 15 dries the base web 34 without applying a compressive force in order to maximize bulk. For example, as shown in FIG. 9, the through-air drying apparatus 15 includes an outer rotatable cylinder 16 with perforations 17 in combination with an outer hood 18. Specifically, the fabric 14 carries the web 34 over the upper portion of the through-air drying apparatus outer cylinder 16. Heated air is drawn through perforations 17 which contacts the web 34 and removes moisture. In one embodiment, the temperature of the heated air forced through the perforations 17 may be from about 170° F. to about 500° F.

The process of the present invention is generally applicable for any high bulk base web. In one embodiment, the base web may have a basis weight between about 10 and about 100 gsm. Additionally, the base web may be fairly porous and may have a Frazier air permeability of greater than about 10 CFM Moreover, the base webs of the present invention may be absorbent base webs, with an Intrinsic Absorbent Capacity of greater than about 2 g $H_2O$/g. More specifically, webs suitable for processing according to the present invention may have an Intrinsic Absorbent Capacity of greater than about 5 g $H_2O$/g.

The initial bulk of the base web, prior to the application of the bonding material and the mechanical straining process of the present invention may be greater than about 10 cc/g. In one embodiment, the initial bulk of the base web may be between about 10 cc/g and about 20 cc/g.

If desired, the base web may be formed from multiple layers of a fiber furnish. Both strength and softness may be further enhanced with layered webs, such as those produced from stratified headboxes. In one embodiment, at least one layer delivered by the headbox comprises softwood fibers while another layer comprises hardwood or other fiber types. Layered structures produced by any means known in the art are within the scope of the present invention. For example, in one embodiment, a paper web with high internal bulk and good integrity of the surfaces may be formed which may include a small portion of synthetic binder fibers present in the web, and the web may have a layered structure with a weak or debonded middle layer and relatively stronger outer layers. For example, outer layers may comprise refined softwood for strength, and the middle layer may comprise over 30% high-yield fibers such as CTMP that have been treated with a debonder. In addition, long synthetic binder fibers, such as bicomponent sheath-core fibers, may be used. In one embodiment, some of the fibers may extend across the middle layer to provide z-direction strength to the web.

In one embodiment, additional bulk may be imparted to the web by the use of bicomponent fibers that curl when heated. This may be especially useful in a middle layer, though fibers that curl when heated could be added anywhere to the web.

In accordance with the present invention, a high bulk web, such as an UCTAD web, may be printed with a bonding material and subjected to softening processes while maintaining most of the web bulk. Specifically, both the printing process and the softening process used on the web are low-compressive processes. Low-compressive processes are herein defined to be processes in which the peak pressure applied to the web during the process is such that the process will not substantially densify the web. Exemplary peak pressures may be any of the following: about 100 psi or less, about 50 psi or less, about 20 psi or less, about 10 psi or less, about 5 psi or less, about 2 psi or less, about 1 psi or less, and about 0.8 psi or less. The same ranges may be applied to the mean pressure on the web during contact with a printing device.

In general, the bonding material may be printed onto at least one side of the web to form a pattern. The pattern on the web may include areas of bonding material as well as areas which are substantially free of the bonding material. In conjunction with printing the bonding material, the web may be softened through one or more of a variety of low-compressive softening processes.

The bonding material may be applied to the web in a printing pattern with a low pressure printing methodology either before, during, or after the web has been subjected to the softening process. In one embodiment, the bonding material may be applied to the web through a flexographic printing process. It has been discovered that flexographic printing of bonding material may provide excellent control of the amount of applied bonding material while applying relatively little pressure to the web being printed.

Any known commercial flexographic equipment may be used, though in some embodiments it may be necessary to be adapted for the present invention. For example, equipment may be provided by Fulflex Inc., (Middletown, R.I.). In one embodiment, Fulflex's real time digital direct-to-plate laser engraving system (Direct Digital Flexo or DDF) may be used to prepare the flexographic plate. Fullflex Laserflex® image transfer materials may also be applied.

Generally, the web will be dry (e.g., about 92% solids or greater), but printing on a moist web is not necessarily outside the scope of the present invention. For example, the web may have a moisture content of 5% or greater, 10% or greater, or 20% or greater, such as from about 5% to 50%, or from 10% to 25%.

FIG. 1 depicts one possible embodiment of a flexographic printing apparatus 20 suitable for printing a bonding material 30 on to an absorbent web 34 according to the processes of the present invention. As may be seen, the plate cylinder 22 may be covered with a flexographic plate 24 which may be engraved or otherwise textured (not shown) with a pattern of raised elements. The flexographic plate 24 typically comprises an elastomeric material, though this is not a requirement of the present invention. For example, the flexographic technology may use rubber rolls, if desired, including those formed of photocured rubber resins, polyesters, or other polymers known in the art, including EPDM nitrile, nitrile PVC, carboxylated nitrile, hydrogenated nitrile, Hypalon, and silicone elastomers.

In a flooded nip 31 between an applicator roll 28 and a counter-rotating roll 26 (typically a rubber roll or doctor roll), a pool 46 of a bonding material 30 is maintained. Either or both of the rolls 26, 28 may be internally heated. An infrared heater or other heat source 48 may also be applied to control the temperature of the pool 46 of bonding material 30, and thus control the viscosity. The counter-rotating roll 26 may help control the delivery of the bonding material 30 to plate 24 and typically may rotate at a lower velocity $U_1$ than the velocity $U_2$ of the applicator roll. In general, the ratio $U_1/U_2$ may be from 0.1 to 0.9, more specifically from about 0.2 to 0.6, and most specifically from about 0.3 to about 0.5.

The applicator roll 28 may be substantially smooth, for example a chrome plated steel roll, a ceramic roll, or a roll with a polymeric cover, or alternatively may be a textured roll, such as an engraved anilox roll of any variety known in the art. The counter-rotating roll 26 generally is smooth, but may also be textured if desired and may comprise any material known in the art.

The bonding material 30 that follows the applicator roll 28 is transferred to the upper portions of the flexographic plate 24. The thickness of the film of bonding material applied to the flexographic plate 24 on the plate cylinder 22 may be governed by controlling roll speeds, bonding material and roll temperatures, application rate, and bonding material viscosity as well as other factors.

In one embodiment, the bonding material is printed by a flexographic plate at a temperature of about 50° C. or higher, specifically about 70° C. or higher, more specifically about 100° C. or higher, and most specifically about 120° C. or higher. The flexographic plate may be heated by infrared radiation, internal heating in the flexographic cylinder, by the application of sufficiently hotbonding material, and the like.

The bonding material 30 applied to the flexographic plate 24 forms a printing layer 32 on the elevated portions of the flexographic plate 24. The printing layer 32 may have a thickness of about 0.03 mm or greater, such as from about 0.05 mm to 2 mm, more specifically from about 0.1 mm to about 1 mm, and most specifically from about 0.2 mm to about 0.7 mm. The printing layer 32 enters a nip 38 between the plate cylinder 22 and an opposing impression cylinder 36 which holds the web 34 against the flexographic plate 24 as it passes through the nip 38, allowing the bonding material 30 in the printing layer 32 to be applied to the web 34 in a predetermined pattern (not shown).

The mechanically applied pressure in the nip 38 is typically less than that applied in gravure printing and generally does not substantially densify the web 34. For example, the applied load may be expressed in terms of pounds per linear inch and may be less than 200 pli such as from about 0.2 pli to 200 pli, more specifically from about 1 pli to about 60 pli, and most specifically from about 2 pli to about 30 pli, or alternatively, less than about 3 pli. The peak pressure applied to the web 34, as measured with pressure-sensitive nip indicator films, may be less than 100 psi, such as from about 0.2 psi to about 30 psi, more specifically from about 0.5 psi to about 10 psi, and most specifically from about 1 psi to about 6 psi, or alternatively, less than 10 psi or less than 5 psi.

The pressure applied to the web during printing may be optimized for the demands of the particular system. For example, it has been discovered that the same pattern applied at a relatively higher load may result in the bonding material being driven more deeply into a porous web, and possibly bleeding away from the elevated print elements of the flexographic plate, such that the bonding material in the web may join many fibers together and result in substantially increased tensile strength in the web. Penetration of the bonding material into the web, when desired, may also be achieved by control of viscosity and surface chemistry (lower viscosity may improve penetration, and bonding material that more easily wets the web or flows into the pores of the web will generally result in improved penetration). The bonding material may penetrate through the entire thickness of the web (100% penetration), or may penetrate to smaller fractional depths of the web, such as penetration levels of about 80% or less, about 50% or less, or about 30% or less.

The web 34 travels in the machine direction 42 through the nip 38 and receives printed material 40 in a pattern on a surface 44. In one embodiment, the pattern may define an essentially continuous network of bonding material 30 on at least one side of the web. If desired, the bonding material may be printed onto the web in a pattern which coincides with a pattern molded into the web, such as, for example, during a through-air drying process. For example, the web may be dried on a highly textured through-air drying fabric or otherwise molded so as to increase web bulk with an increase in the three dimensional characteristic of the web, and the bonding material may be printed onto the web in a pattern which coincides with the pattern molded into the web. In this embodiment, the cured bonding material may help to maintain the added three-dimensional pattern of the web while simultaneously strengthening the sheet.

The thickness of the printed material 40 relative to the surface 44 of the web 34 may vary over a wide range of obtainable values. Without limitation, the thickness may be about 1 millimeter or less, specifically about 0.5 mm or less, more specifically about 0.25 mm or less microns, more specifically still about 0.1 mm or less, and most specifically about 0.05 mm or less, with exemplary ranges of from 0 to 0.1 mm, from 0.05 mm to 1 mm, or from 0.1 mm to 0.4 mm.

In an alternative embodiment (not shown), the impression cylinder 36 may be removed and the web 34 may be simply wrapped around a portion of the flexographic plate 24, such that the force applied to contact the web 34 to the flexographic plate 24 is provided by the tension in the web 34, and such that the contact time between the web 34 and the flexographic plate 24 is correspondingly larger due to a contact length that may be much greater than the nip length in the nip 38. Such an embodiment is known as "kiss coating." The low application pressure may help keep the coating material 30 on the surface 44 of the web 34 in this low-pressure process. This keeps the material on the upper surface of the web. Kiss coating may also be done with a gravure cylinder (not shown), an applicator roll 28, or other cylinder-containing bonding material for low pressure printing to the web 34. In one embodiment, kiss coating is done with an applicator roll 28 (e.g., an anilox roll) with a surface pore volume of 2 billion to 6 billion cubic microns per square inch (BCM). In kiss coating as in any other embodiment, digital drives and control systems may be used to maintain proper speed of all components.

Figure 2:
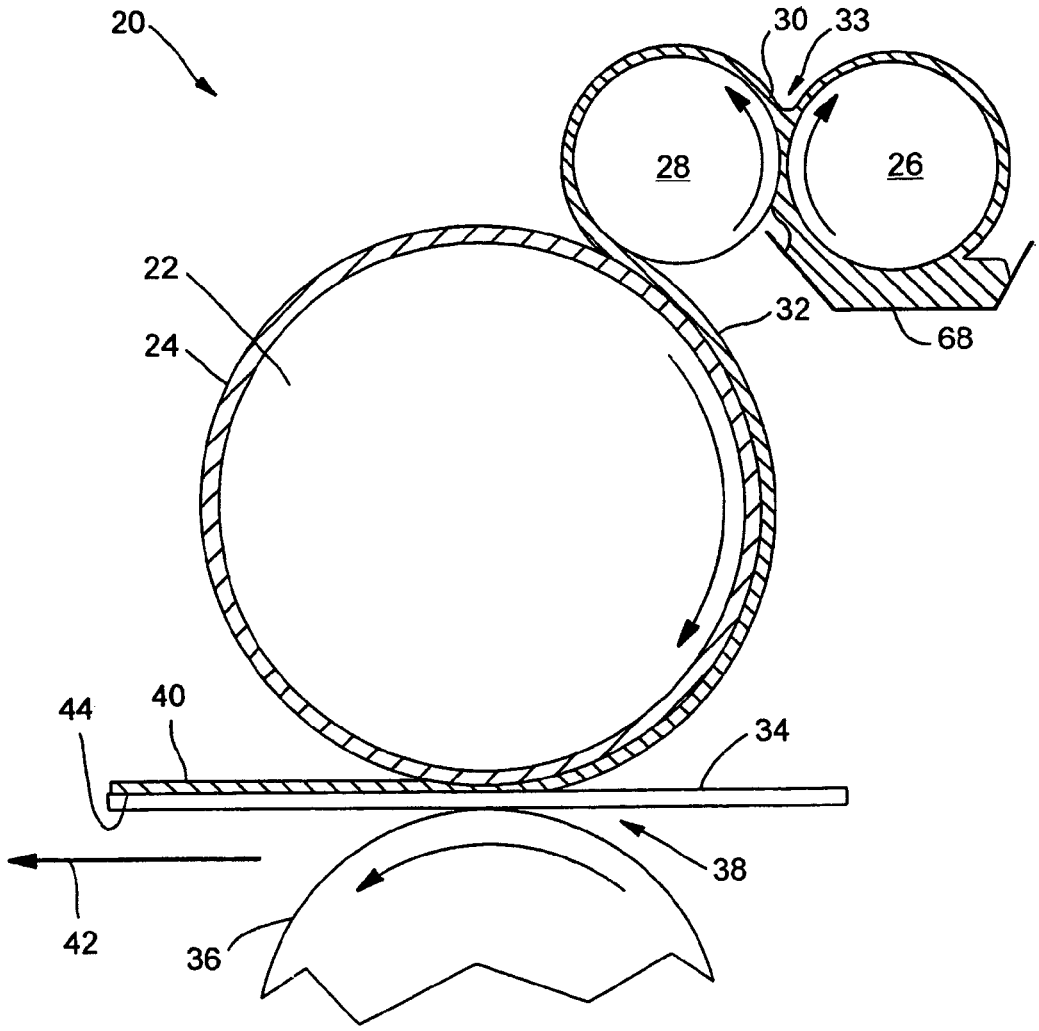
FIG. 2 depicts another embodiment of a flexographic printing apparatus suitable for use in the process of the present invention.

FIG. 2 is a schematic of another embodiment of a flexographic printing apparatus 20 suitable for use in the process of the present invention. The flexographic printing apparatus 20 employs a metered nip 33 between two counter-rotating rolls 26, 28. Bonding material 30 may be applied to the counter-rotating roll 26 via any means such as a nozzle (not shown) through which the bonding material 30 is applied. Excess bonding material 30 may be collected in a tray 68. Bonding material 30 may also be applied by contact of the counter-rotating roll 26 with bonding material 30 in the tray 68.

Figure 3:
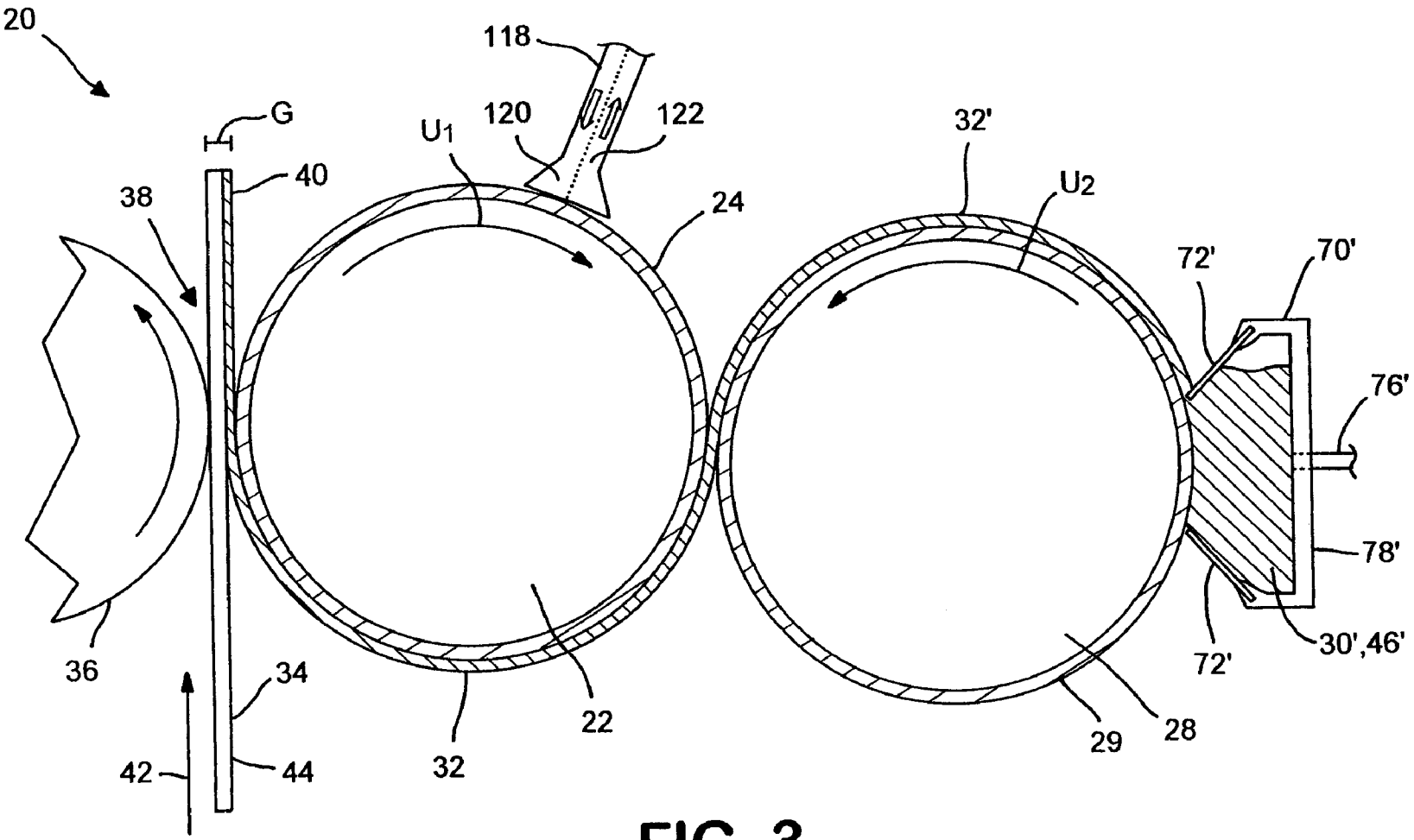
FIG. 3 shows another embodiment of a flexographic printing apparatus suitable for use in the process of the present invention.

FIG. 3 depicts another embodiment of a flexographic printing apparatus 20 for use in the processes of the present invention. The bonding material 30' is applied to the flexographic plate 24 by means of an applicator roll 28 which receives a metered coating of bonding material 32' (or bonding material 30' applied to depressions in the surface of the applicator roll 28) by means of an enclosed application chamber 70' having a chamber body 78' connected to an inlet tube 76' for receiving bonding material 30' in flowable form (e.g., a liquid or a slurry), and further provided with a leading blade 72' and a trailing blade 72' for keeping the bonding material 30' in a pool 46' in contact with the cover 29 of the applicator roll 28. The trailing blade 72' is adjusted to meter a desired amount of the bonding material onto the applicator roll 28. Optionally, the application chamber 70' may be heated and maintained at a substantially constant temperature with temperature control means (not shown) to provide the bonding material 30' at a desired viscosity.

The applicator roll 28 is depicted as having a polymeric cover 29 which may be deformable, such as a high-temperature elastomeric material, or may be a polymer with low affinity for the molten bonding material 30 to promote good transfer from the applicator roll 28 to the flexographic plate 24.

The flexographic cylinder 22 rotates at a first velocity $U_1$ (velocity being measured at the outer surface of the roll), while the applicator roll 28 rotates at a second velocity $U_2$. The second velocity $U_2$. may be substantially less than the first velocity $U_1$ for metering of the coating of bonding material 32', 32 to the flexographic plate 24. For example, the ratio $U_2/U_1$ may be from about 0.2 to 1, more specifically from about 0.4 to 0.8, and most specifically from about 0.4 to about 0.7.

The flexographic cylinder 22 may be cleaned to remove excess bonding material 30' still on the flexographic plate 24 after printing of the web 34 in the nip 38. A plate cleaner 118 may be used which comprises an inlet line 120 conveying a cleaning material (not shown) to the surface of the flexographic plate 24, in cooperation with an adjacent vacuum line 122 for removing the cleaning material and excess bonding material 30' conveyed thereby. The cleaning material may be a solvent, including water (e.g., a spray of water droplets or water jets) or steam, for water-soluble bonding materials (e.g., water soluble hot melts) or water-based emulsions (e.g., a latex). The cleaning material may also be an organic solvent or other materials. Commercial plate cleaners may be used, such as Tresu Plate Cleaners (Tresu, Inc., Denmark) or the plate cleaners of Novaflex, Inc. (Wheaton, Ill.).

Figure 10:
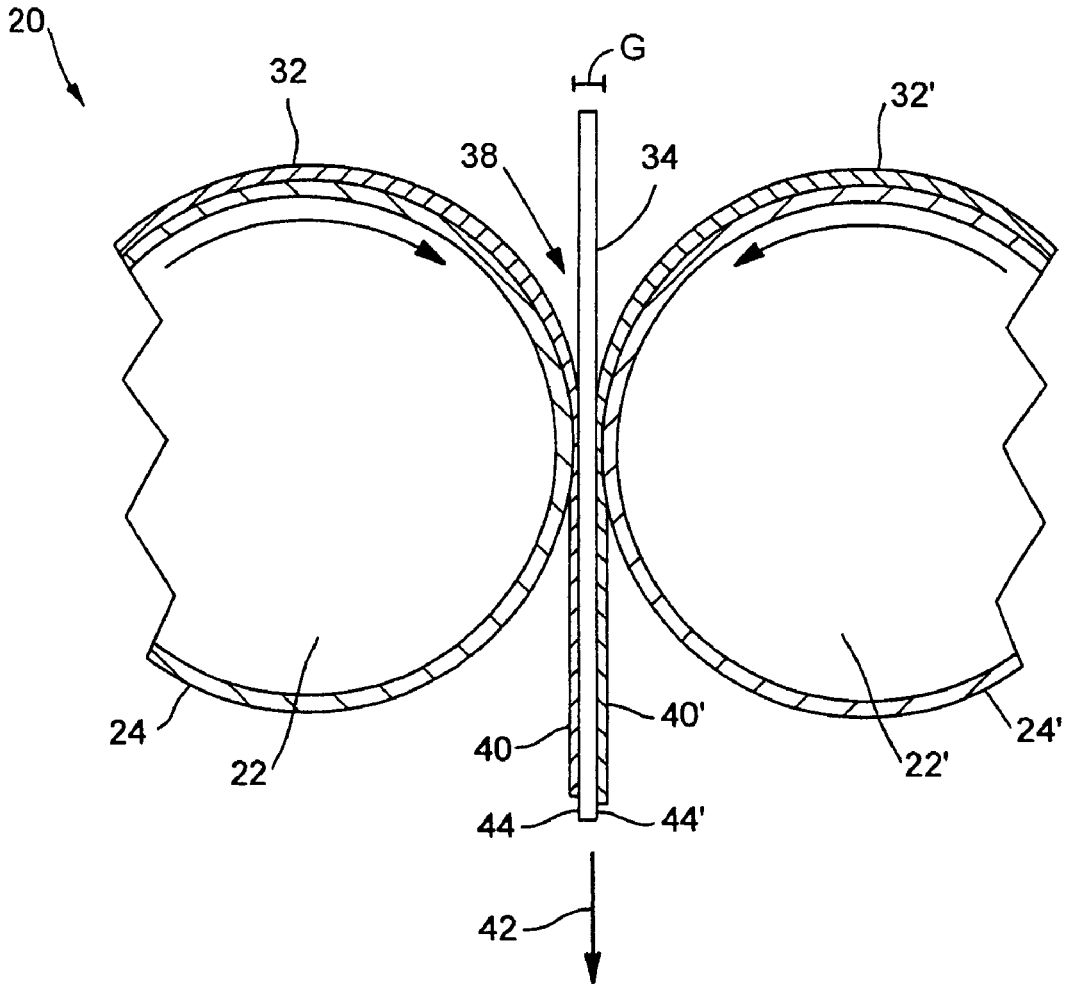
FIG. 10 depicts an embodiment of a flexographic printing system.

FIG. 10 depicts another embodiment of a flexographic printing apparatus 20 for use in the processes of the present invention. The apparatus 20 operates in duplex flexographic mode with similar equipment on both sides of the web 34, including opposing first and second plate cylinders 22, 22', with first and second flexographic plates 24, 24' upon which first and second bonding materials 32, 32' have been provided, respectively by any means, such as by transfer of the bonding materials 30, 30' from applicator rolls (not shown) as in a duplex four-roll flexo system. The respective applicator rolls (not shown) that cooperate with the first and second flexographic plates 24, 24' may receive the bonding material 32, 32' by any means known in the art, such as by a spray, a curtain of melt or liquid flowing onto the applicator rolls, transfer from a flooded nip or metered nip with a counter-rotating roll (not shown), contact with bonding materials 32, 32' in a tray or enclosed chamber, delivery of the bonding material through the interior chamber of a sintered roll to the surface thereof, from which the bonding material is transferred to the flexographic plates 24, 24', and so forth. The first and second flexographic plates 24, 24' are separated by a gap offset G which may be adjusted to prevent substantial densification or crushing of a high-bulk web 34. When the flexographic plates 24, 24' receive bonding material 32, 32' from applicator rolls in fluid communication with an enclosed chamber (not shown), the printing equipment configuration on both sides of the web 34 may resemble that shown for printing on one side of the web 34 in FIG. 3.

Unlike the method of driving ink transfer in conventional flexography, the process of the present invention may print a bonding material onto a web surface with very little or even no additional pressure at a printing nip of a printing apparatus. For instance, in some embodiments, the bonding material-bearing surfaces of the plate cylinder need not press against the web as it resides on a smooth impression cylinder. Local web tension as the web is held by raised elements on the plate cylinder may suffice to cause suitable web contact against the bonding material to permit transfer of the bonding material onto the surface of the web. As such, in some embodiments, the printing process may be carried out with a flexographic printing apparatus which does not include an impression cylinder at all.

Figure 8:
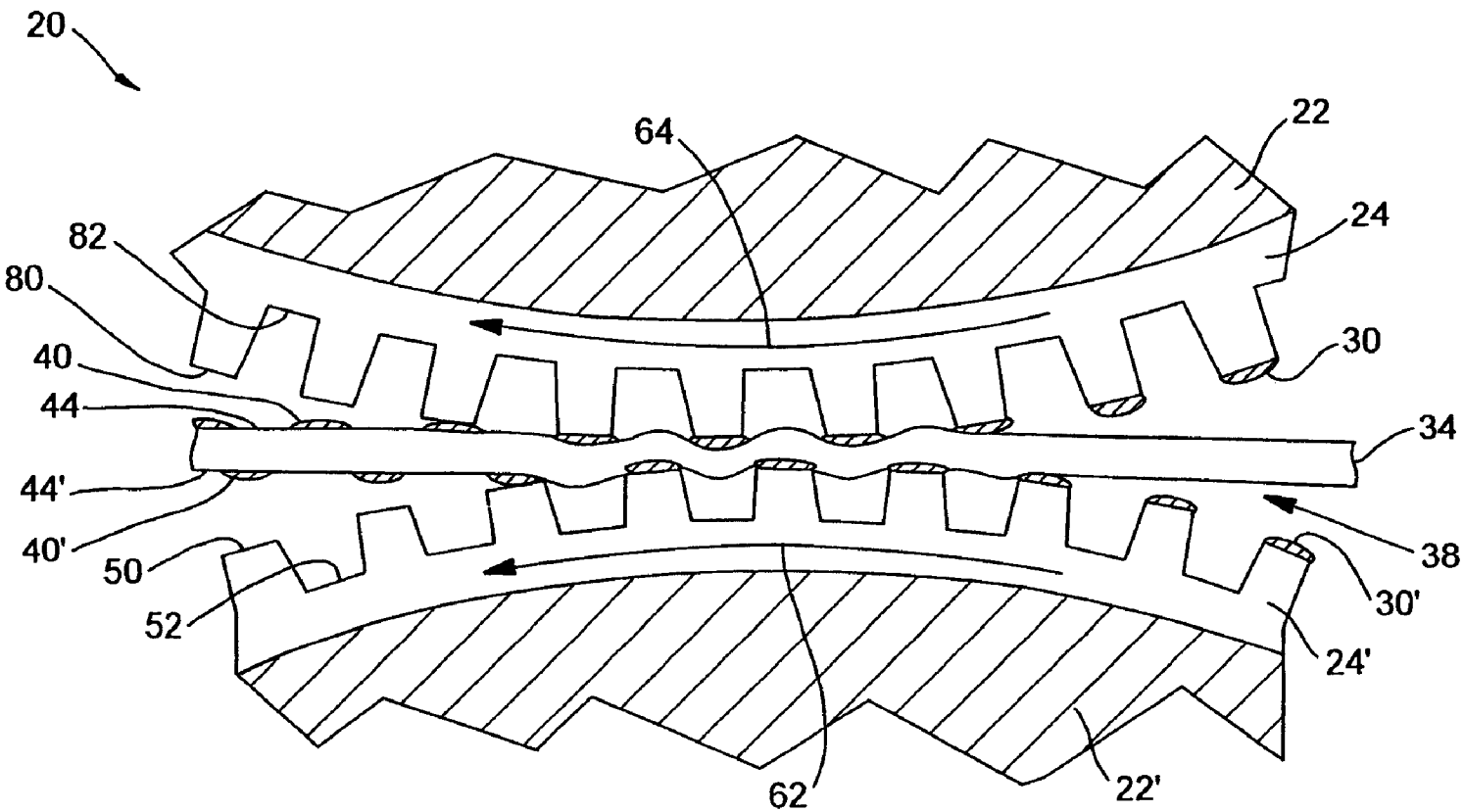
FIG. 8 is a schematic of an embodiment of a duplex flexographic nip as a web is printed with bonding material on both sides.

In certain embodiments, the bonding material may be printed onto both surfaces of the base web. For example, two printing steps may be used to provide printing of bonding material to both surfaces of the web. FIG. 8 depicts an embodiment of a duplex flexographic printing apparatus 20 in which first and second bonding materials 30, 30' are applied simultaneously to both sides of a web 34 as the web 34 contacts first and second flexographic plates 24, 24', respectively, in a nip 38 between first and second cylinders 22, 22', respectively. As shown, the patterns on first and second flexographic plates 24, 24' are not aligned but are skewed such that the printed bonding material deposits 40, 40' on the first and second surfaces 44, 44', respectively, of the web 34 are generally not directly above or beneath each other, but are staggered relative to each other. In other embodiments, the patterns on the opposing flexographic plates 24, 24' could be aligned or could randomly vary relative to each other. When the first and second flexographic plates 24, 24' are identical, one may be rotated with respect to the other, if desired, to prevent printing of identical overlapping patterns on both sides of the web 34, or they may be aligned such that identical overlapping patterns are printed.

Delivery of the bonding material to the surface of a web is not limited to flexographic printing technologies. Delivery of the bonding material in a desired pattern may be achieved with any relatively low pressure printing technique as long as the temperature and other parameters of the process are controlled to provide a bonding material with suitable viscosity for the printing process. For example, various inkjet printing methods may be used, including thermal drop on demand (DoD) inkjet, piezoelectric DoD inkjet, airbrush/valve jet, continuous ink-jet, electrostatic sublimation and resin, electrophotography, laser and LED, thermal transfer, photographic development, and the like. An exemplary commercial digital printing system suitable for use in the present invention is the CreoScitex SP laser imaging system.

By way of example only, the bonding material may be one of the Advantra™ series of hotmelts from H.B. Fuller Company (St. Paul, Minn.), such as HL 9253 packaging bonding material which has a recommended application temperature of 350° F., a viscosity of 1640 centiPoise (cP) at 350° F., 2380 cP at 325° F., and 1230 cP at 375° F., a specific gravity of 0.926, a Gardner Color value of 1 (the Gardner Color scale is described in ASTM D-1544, "Standard Test Method for Color of Transparent Liquids (Gardner Color Scale)"). Further examples include the class of Rapidex® Reactive Hot Melt bonding materials as well as the Clarity™ bonding materials, both also of H.B. Fuller Company. Clarity™ HL-4164 hot melt bonding material, for example, has a Gardner Color of 4, a recommended application temperature of 300° F., a viscosity at 300° F. of 805 cP, a viscosity at 250° F. of 2650 cP, and a viscosity at 350° F. of 325 cP, with a specific gravity of 0.966. The Epolene waxes of Eastman Chemical Company represent another class of suitable hotmelts. One example is Epolene™ N021 Wax, with a softening point (Ring and Ball Softening Point) of 120° C., a weight-averaged molecular weight of 6,500 and a number-averaged molecular weight of 2,800 (unless otherwise specified, "molecular weight" as used herein refers to number-weighted molecular weight), a Brookfield viscosity of 350 cP at 150° C., and a cloud point of 87° C. (for a 2% solution in paraffin at 130° C.). Another example is Epolene™ G3003 Polymer, with a softening point of 158° C., a Brookfield viscosity at 190° C. of 60,000 cP, and a weight-averaged molecular weight of 52,000 and a number-averaged molecular weight of 27,200 and an acid number of 8 (in one embodiment, suitable hotmelts may have an acid number of about 8 or less, such as less than 2).

In one embodiment, latex may be a useful bonding material. Latex emulsions or dispersions generally comprise small polymer particles, such as cross linkable ethylene vinyl acetate copolymers, typically in spherical form, dispersed in water and stabilized with surface active ingredients such as low molecular weight emulsifiers or high molecular weight protective colloids. When latex is used, the latex may be anionic, cationic, or nonionic. Crosslinking agents such as NMA may be present in a latex polymer, added as a separate ingredient, or not present at all. A latex emulsion may be thickened, if desired, with known viscosity modifiers such as Acrysol® RM-8 from Rohm & Haas Company (Philadelphia, Pa.).

A variety of commercial latex emulsions may be considered, including those selected from the Rovene® series (styrene butadiene latices available from Mallard Creek Polymers of Charlotte, N.C.); the Rhoplex® lattices of Rohm and Haas Company; the Elite® lattices of National Starch, a variety of vinyl acetate copolymer lattices, such as 76 RES 7800 from Union Oil Chemicals Divisions and Resyn 25-1103, Resyn 25-1109, Resyn 25-1119, and Resyn 25-1189 from National Starch and Chemical Corporation; ethylenevinyl acetate copolymer emulsions, such as Airflex ethylene-vinylacetate from Air Products and Chemicals Inc.; acrylicvinyl acetate copolymer emulsions; Synthemul™ 97-726 from Reichhold Chemicals Inc.; vinyl acrylic terpolymer lattices, such as 76 RES 3103 from Union Oil Chemical Division;

acrylic emulsion lattices, such as Rhoplex™ B15J or other Rhoplex™ latex compounds from Rohm and Haas Company; and Hycar 2600×322 and related compounds from B. F. Goodrich Chemical Group; styrene-butadiene lattices, such as 76 RES 4100 and 76 RES 8100 available from Union Oil Chemicals Division; Tylac™ resin emulsions from Reichhold Chemical Inc.; DL6672A, DL6663A, DL6638A, DL6626A, DL6620A, DL615A, DL617A, DL620A, DL640A, and DL650A available from Dow Chemical Company; rubber lattices, such as neoprene available from Serva Biochemicals; polyester lattices, such as Eastman AQ 29D available from Eastman Chemical Company; vinyl chloride lattices, such as Geon™ 352 from B. F. Goodrich Chemical Group; ethylenevinyl chloride copolymer emulsions, such as Airflex™ ethylenevinyl chloride from Air Products and Chemicals; polyvinyl acetate homopolymer emulsions, such as Vinac™ from Air Products and Chemicals; carboxylated vinyl acetate emulsion resins, such as Synthemul™ synthetic resin emulsions 40-502, 40-503, and 97-664 from Reichhold Chemicals Inc. and Polyco™ 2149, 2150, and 2171 from Rohm and Haas Company. Silicone emulsions and binders may also be considered.

In one embodiment, the bonding material is not a latex, and in another embodiment the printed web may be substantially latex free or substantially free of natural latex.

In those embodiments wherein the bonding material is insoluble or resistant to water, the resulting molded web may have high wet resiliency, characterized by an ability to maintain high bulk and a three-dimensional structure when wet. In those embodiments wherein the bonding material is printed on both sides of a web, the bonding material may be the same or different compositions on either side.

When a hotmelt bonding material is used, the equipment for processing the hotmelt and supplying a stream of hotmelt to the printing systems of the present invention may be any known hotmelt processing devices. For example, the ProFlex® applicators of Hot Melt Technologies, Inc (Rochester, Mich.); the "S" Series Adhesive Supply Units of ITW Dynatec, Hendersonville, Tenn., as well as the DynaMelt "M" Series Adhesive Supply Units, the Melt-on-Demand Hopper, and the hotmelt Adhesive material Feeder, all of ITW Dynatec are all exemplary systems which may be used.

The bonding material compound may be substantially free of ink or may be a compound that does comprise an ink.

Silicone pressure sensitive adhesives could also be used as the bonding material in the present invention. Exemplary silicone pressure sensitive adhesives which may be used may include those commercially available from Dow Corning Corp., Medical Products and those available from General Electric. While not limiting, examples of possible silicone adhesives available from Dow Corning include those sold under the trade names BIO-PSA X7-3027, BIO-PSA X7-4919, BIO-PSA X7-2685, BIO-PSA X7-3122 and BIO-PSA X7-4502.

If desired, coloring additives may be included in the bonding material and the bonding material may be white, colored or colorless. Other optional additives, in addition to inks, may also be added to the bonding material in minor amounts (typically less than about 25% by weight of the elastomeric phase) if desired. Such additives may include, for example, pH controllers, medicaments, bactericides, growth factors, wound healing components such as collagen, antioxidants, deodorants, perfumes, antimicrobials and fungicides.

The bonding material may be substantially free of water (e.g., water is not used as a solvent or carrier material for the binder material), or may be substantially free of dyes or pigments (in contrast to typical inks), and may be substantially non-pigmented or uncolored (e.g., colorless or white), or may have a Gardner Color of about 8 or less, more specifically about 4 or less, and most specifically about 1 or less. In another embodiment, HunterLab Color Scale (from Hunter Associates Laboratory of Reston, Va.) measurements of the color of a 50 micron film of the bonding material on a white substrate yields absolute values for "a" and "b" each about 25 or less, more specifically each about 10 or less, more specifically still each about 5 or less, and most specifically each about 3 or less. The HunterLab Color Scale has three parameters, L, a, and b. "L" is a brightness value, "a" is a measure of the redness (+a) and greenness (−a), and the "b" value is a measure of yellowness (+b) and blueness (−b). For both the "a" and "b" values, the greater the departure from 0, the more intense the color. "L" ranges from 0 (black) to 100 (highest intensity). The bonding material may have an "L" value (when printed as a 50 micron film on a white background) of about 40 or greater, more specifically about 60 or greater, more specifically still about 80 or greater, and most specifically about 85 or greater. Measurement of materials to obtain HunterLab L-a-b values may be done with a Technibryte Micro TB-1C tester manufactured by Technidyne Corporation, New Albany, Ind., USA.

In one embodiment, the bonding material may comprise an acrylic resin terpolymer. For example, the bonding material may comprise an acrylic resin terpolymer containing 30 to 55 percent by weight styrene, 20 to 35 percent by weight acrylic acid or methacrylic acid and 15 to 40 percent by weight of N-methylol acrylamide or N-methylol methacrylamide, or may comprise a water-soluble melamine-formaldehyde aminoplast and an elastomer latex.

Other suitable bonding materials include acrylic based pressure sensitive adhesives (PSAs), suitable rubber based pressure sensitive adhesives and suitable silicone pressure sensitive adhesives. Examples of suitable polymeric rubber bases include one or more of styrene-isoprene-styrene polymers, styrene-olefin-styrene polymers including styrene-ethylene/propylene-styrene polymers, polyisobutylene, styrenebutadiene-styrene polymers, polyisoprene, polybutadiene, natural rubber, silicone rubber, acrylonitrile rubber, nitrile rubber, polyurethane rubber, polyisobutylene rubber, butyl rubber, halobutyl rubber including bromobutyl rubber, butadieneacrylonitrile rubber, polychloroprene, and styrene-butadiene rubber.

In one embodiment, a rubber based bonding material may be used that may have a thermoplastic elastomeric component and a resin component. The thermoplastic elastomeric component may contains about 55-85 parts of a simple A-B block copolymer wherein the A-blocks are derived from styrene homologs and the B-blocks are derived from isoprene, and about 15-45 parts of a linear or radical A-B-A block copolymer wherein the A-blocks are derived from styrene or styrene homologs and the B blocks are derived from conjugated dienes or lower alkenes, the A-blocks in the A-B block copolymer constituting about 10-18 percent by weight of the A-B copolymer and the total A-B and A-B-A copolymers containing about 20 percent or less styrene. The resin component may comprise tackifier resins for the elastomeric component. In general, any compatible conventional tackifier resin or mixture of such resins may be used. These include hydrocarbon resins, rosin and rosin derivatives, polyterpenes and other tackifiers. The bonding material composition may contain about 20-300 parts of the resin component per one hundred parts by weight of the thermoplastic elastomeric component. One such rubber-based bonding material is commercially available from Ato Findley under the trade name HM321 0.

Many different types of monomers and cross-linkable resins are known in the polymer art, their properties may be adjusted as taught in the art to provide rigidity, flexibility, or other properties.

Various types of elastomeric compositions are known, such as curable polyurethanes. The term "elastomer" or "elastomeric" is used to refer to rubbers or polymers that have resiliency properties similar to those of rubber. In particular, the term elastomer reflects the property of the material that it may undergo a substantial elongation and then return to its original dimensions upon release of the stress elongating the elastomer. In all cases an elastomer must be able to undergo at least 10% elongation (at a thickness of 0.5 mm) and return to its original dimensions after being held at that elongation for 2 seconds and after being allowed 1-minute relaxation time. More typically an elastomer may undergo 25% elongation without exceeding its elastic limit. In some cases elastomers may undergo elongation to as much as 300% or more of its original dimensions without tearing or exceeding the elastic limit of the composition. Elastomers are typically defined to reflect this elasticity as in ASTM Designation DS83-866 as a macromolecular material that at room temperature returns rapidly to approximately its initial dimensions and shape after substantial deformation by a weak stress and release of the stress. ASTM Designation D412-87 may be an appropriate procedure to evaluate elastomeric properties. Generally, such compositions include relatively high molecular weight compounds which, upon curing, form an integrated network or structure. The curing may be by a variety of means, including: through the use of chemical curing agents, catalysts, and/or irradiation. The final physical properties of the cured material are a function of a variety of factors, most notably: number and weight average polymer molecular weights; the melting or softening point of the reinforcing domains (hard segment) of the elastomer (which, for example, may be determined according to ASTM Designation D1238-86); the percent by weight of the elastomer composition which comprises the hard segment domains; the structure of the toughening or soft segment (low Tg) portion of the elastomer composition; the cross-link density (average molecular weight between crosslinks); and the nature and levels of additives or adjuvants, etc. The term "cured", as used herein, means cross-linked or chemically transformed to a thermoset (non-melting) or relatively insoluble condition.

The softening temperature of a thermoplastic polymer may be approximated as the Vicat Softening Temperature according to ATM D 1525-91.

The bonding material may also comprise acrylic polymers including those formed from polymerization of at least one alkyl acrylate monomer or methacrylate, an unsaturated carboxylic acid and optionally a vinyl lactam. Examples of suitable alkyl acrylate or methacrylate esters include, but are not limited to, butyl acrylate, ethyl acrylate, 2-ethylhexyl acrylate, isooctyl acrylate, isononyl acrylate, isodecyl acrylate, methyl acrylate, methylbutyl acrylate, 4-methyl-2-pentyl acrylate, see-butyl butyl acrylate, ethyl methacrylate, isodecyl methacrylate, methyl methacrylate, and the like, and mixtures thereof. Examples of suitable ethylenically unsaturated carboxylic acids include, but are not limited to, acrylic acid, methacrylic acid, fumaric acid, itaconic acid, and the like, and mixtures thereof. A preferred ethylenically unsaturated carboxylic acid monomer is acrylic acid. Examples of suitable vinyl lactams include, but are not limited to, N-vinyl caprolactam, 1-vinyl-2-piperidone, 1-vinyl-5-methyl-2-pyrrol id one, vinyl pyrrolidone, and the like, and mixtures thereof.

The bonding material may also include a tackifier. Tackifiers are generally hydrocarbon resins, wood resins, rosins, rosin derivatives, and the like. It is contemplated that any tackifier known by those of skill in the art to be compatible with elastomeric polymer compositions may be used with the present embodiment of the invention. One such tackifier found to be suitable is Wingtak 10, a synthetic polyterpene resin that is liquid at room temperature, and sold by the Goodyear Tire and Rubber Company of Akron, Ohio. Wingtak 95 is a synthetic tackifier resin also available from Goodyear that comprises predominantly a polymer derived from piperylene and isoprene. Other suitable tackifying additives may include Escorez 1310, an aliphatic hydrocarbon resin, and Escorez 2596, aC5-C9 (aromatic modified aliphatic) resin, both manufactured by Exxon of Irving, Tex. Of course, as may be appreciated by those of skill in the art, a variety of different tackifying additives may be used to practice the present invention.

In addition to tackifiers, other additives may be used to impart desired properties. For example, plasticizers may be included. Plasticizers are known to decrease the glass transition temperature of a bonding material composition containing elastomeric polymers. An example of a suitable plasticizer is Shellflex 371, a naphthenic processing oil available from Shell Oil Company of Houston, Tex. Antioxidants also may be included in the bonding material compositions. Exemplary antioxidants include Irgafos 168 and Irganox 565 available from Ciba-Geigy, Hawthorne, N.Y. Cutting agents such as waxes and surfactants also may be included in the bonding materials.

In another embodiment, the bonding material may be substantially free of quaternary ammonium compounds, or may be substantially free independently of any of the following or any combination thereof: petrolatum, silicone oil, beeswax, paraffin, fatty acids, fattyalcohols, any hydrophobic material with a melting point less than 50° C., epichlorohydrins, conventional papermaking wet strength additives (either temporary or permanent wet strength additives or both), starches and starch derivatives, gums; cellulose derivatives such as carboxymethylcellulose or carboxyethylcellulose; chitosan or other materials derived from shellfish; materials derived from proteins; super absorbent material; a polyacrylate or polyacrylic acid; cationic polymers, surfactants, polyamides, polyester compounds, chlorinated polymers, heavy metals, water soluble polymers, water-soluble salts, a slurry, a dispersion, and opaque particles. In one embodiment, for example, the bonding material is not a water-soluble wet strength agent, such as a cationic nitrogen-containing polymer. It may also have a softening temperature about 60° C., such as about 80° C. or greater, more specifically about 100° C. or greater, most specifically about 130° C. or greater.

The bonding material printed on the web may set or cure in any fashion. For example, the bonding material may set or cure through application of heat, ultraviolet light or other forms of radiation, or due to chemical reaction which may merely require passage of a period of time. In one embodiment, the bonding material may cure through application of airflow, as when the base web is pressed against a molding substrate by pneumatic pressure. IN one embodiment, the bonding material is cured prior to subjecting the web to the softening processes of the present invention.

The printed bonding material, in one embodiment, does not penetrate fully into the web but may remain at least 10 microns above the surface of the web, more specifically at least about 20 microns above the surface of the web, most specifically at least about 50 microns above the surface of the web.

The bonding material, after application to the web, may be substantially non-tacky (particularly after it has cooled to a temperature of 40° C. or less, or 30° C. or less). In many embodiments, the printed bonding material is not used to join the tissue web to any other layer or article, but is used to modify at least one of the following: the structure of the tissue web, the strength properties of the tissue web, the topography of the tissue web (increasing the texture or surface depth of the web), the wetting properties of the web, and the tactile properties of the web. More specifically, the printing of bonding material is used to create a high bulk web with enhanced texture and improved strength or wet resiliency. Wet Compressed Bulk refers to the bulk of a fully wetted tissue sample (wetted to a moisture ratio of 1.1 g water/g dry fiber) under a load of 2 psi. Springback, refers to the ratio of final low-pressure thickness at 0.025 psi to the initial low-pressure thickness at 0.025 psi of a fully wetted sample after two intervening compressive cycles comprising loading the tissue to 2 psi followed by removing the load. By way of example, a Springback of 1 indicates no loss in bulk of the sample due to intermediate compressions to 2 psi, whereas a value of 0.5 indicates that half of the bulk was maintained. The Wet Compressed Bulk of the web may be increased by about 5% or more, specifically by about 10% or more, more specifically by about 15% or more, most specifically by about 25% or more, by flexographic printing of bonding material according to the present invention, relative to an unprinted but otherwise substantially identical sample. The Springback may be increased by 0.03 or more, more specifically by about 0.05, most specifically by about 0.1 or more, by flexographic printing of bonding material according to the present invention, relative to an unprinted but otherwise substantially identical sample.

The bonding material may be applied to the web in any desired pattern. For example, the bonding material may form a continuous network or an effectively continuous network, such as through a pattern of small, discrete dots. In one embodiment, the pattern may extend across the entire face of the web. A pattern of small discrete dots may be effectively continuous when the dots are spaced apart at a distance substantially less than the typical fiber length such that the dots define a pattern capable of enhancing the tensile strength of the web. For example, a web may be formed including softwood fibers with a mean fiber length of about 4 mm, and a pattern of fine dots having a diameter of about 0.5 mm or less may be spaced apart less than 1 mm between centers of the dots in a large-scale honeycomb pattern or rectilinear grid pattern, wherein the width of the characteristic bonding material-free honeycomb cell or rectilinear grid cell is about 3 mm or less.

The bonding material may be printed in any desired pattern such as an interconnected network or a series of isolated elements or a combination of a network and isolated elements. The pattern may define recognizable objects such as flowers, stars, animals, humans, cartoon characters, and the like, or aesthetically pleasing patterns of any kind. For example, the pattern may comprise a series of parallel lines, parallel sinuous curves, a rectilinear grid, a hexagonal grid, isolated or overlapping circles or ellipses, isolated or overlapping polygons, isolated dots and dashes, and the like.

The area of the surface of the web that is covered by the bonding material may range from about 1% to about 100%, such as from about 5% to about 95%, specifically from about 10% to about 80%, more specifically from about 10% to about 50%, and most specifically from about 10% to about 40%. Alternatively, area of the surface of the web that is covered by the bonding material may be less than 50%, such as less than 30% or less than 15%, such as from 1% to 15%.

In one embodiment, the parameters of the pattern of the bonding material that is printed on the sheet may be dependent on the fiber length of the fibers in the outer surfaces of the web. Such interdependence may help to maintain good surface integrity. In those embodiments including long synthetic fibers in one or both outer surfaces of the web, the bonding material may be printed at a coarser scale and the web may still exhibit substantial gain in tensile and strength properties. Thus, with synthetic fibers of, for example, 15 mm or greater average length, the bonding material may be printed in a pattern having a characteristic cell size of about 5 mm or less.

Figure 5:
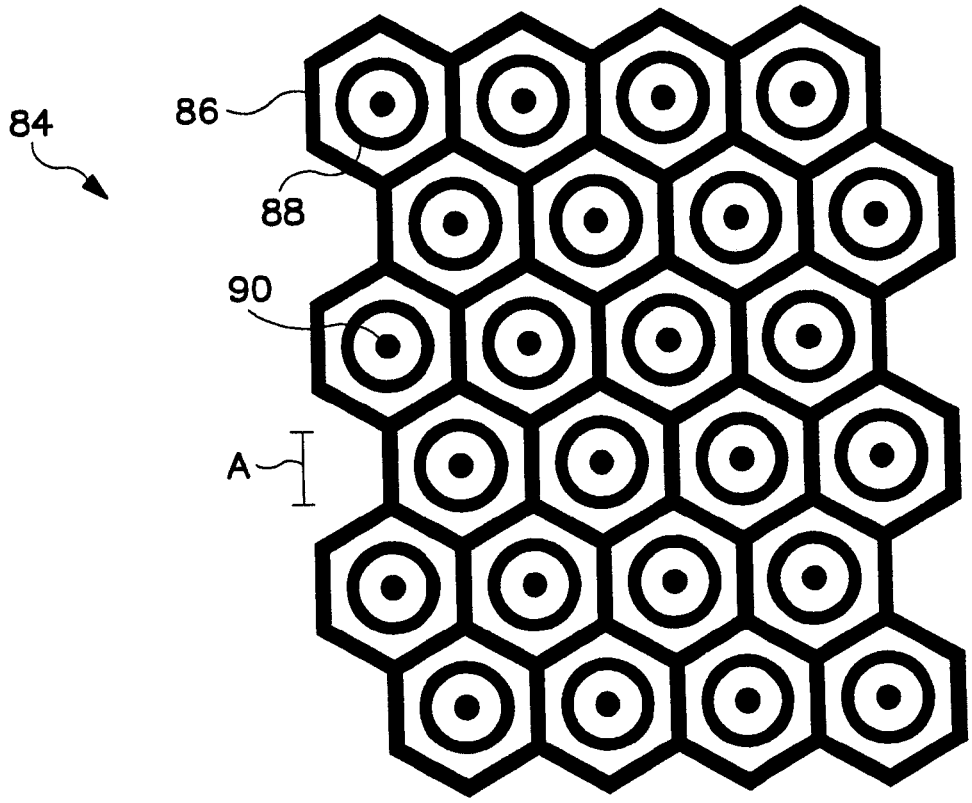
FIG. 5 depicts one possible printing pattern of a bonding material that may be imparted to a web according to the present invention.

FIG. 5 is a schematic of one embodiment of a pattern 84 of bonding material that may be printed onto a web (not shown) such as with a corresponding pattern engraved into a flexographic plate. In this embodiment, the pattern 84 includes a continuous network of hexagonal elements 86, with circles 88 and dots 90 within the hexagonal elements 86. The sides of the hexagonal elements 86 may have a characteristic length 'A' that may be about 0.5 mm or greater, more specifically about 1 mm or greater, more specifically still about 2.5 mm or greater, and most specifically about 5 mm or greater, with exemplary ranges of from about 1.5 mm to about 18 mm, or from about 3 mm to about 7 mm. In one embodiment, the characteristic length A is approximately equal to the length-weighed numerical average fiber length of the web or less, such as about 5 mm or less for a typical softwood tissue web or about 2 mm or less for a predominately hardwood tissue web. The pattern 84 of FIG. 5 is, of course, only one of countless different patterns that could be employed. Characteristic unit cells of such patterns may include elements of any shape, such as, for example, rectangles, diamonds, circles, ovals, bow-tie shaped elements, tessellated elements, repeating or non-repeating tile elements, dots, dashes, stripes, grid lines, stars, crescents undulating lines, and the like, or combinations thereof. The characteristic width or length of the unit cell may be about 0.5 mm or greater, specifically about 1 mm or greater, more specifically about 2 mm or greater, and most specifically about 5 mm or greater, such as from about 0.5 mm to about 7 mm, or from about 0.8 mm to about 3.5 mm.

Figure 6:
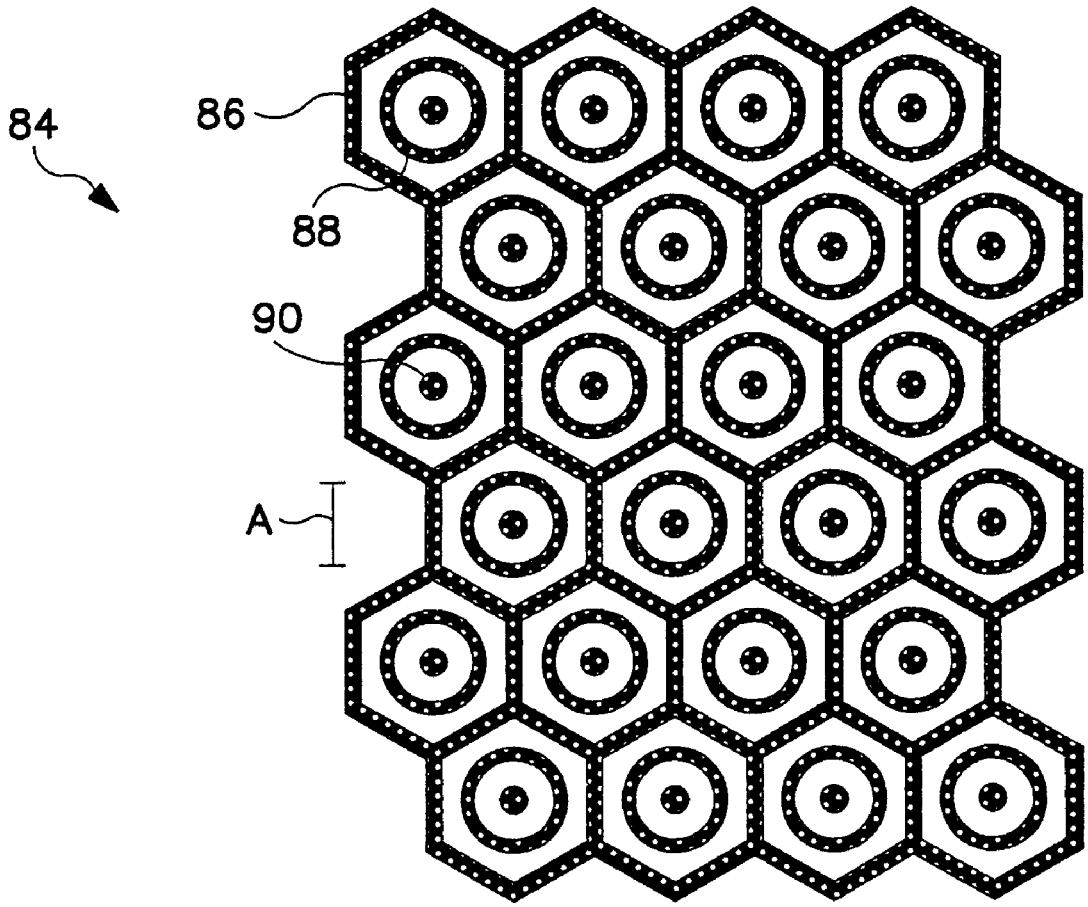
FIG. 6 depicts another possible printing pattern of a bonding material that may be imparted to a web according to the present invention.

FIG. 6 is a schematic of a pattern 84 of bonding material similar to that of FIG. 5, except that the present pattern 84 has been screened such that the solid portions of the pattern are broken up with fine dots 94 of unprinted regions. In experiments with hot melt bonding materials, it has been found that by providing the screen effect shown in FIG. 6, better transfer of the hot melt to the surface of the web may be achieved. Advantages appear possible even for very small amounts of open surface area in the otherwise solids portions of the pattern. Thus, by combining unprinted dots or other elements to form a screening effect on the pattern 84, improved texturing of the web may be achieved. In some embodiments, the pattern of dots in the printing surface may serve as small reservoirs to hold more bonding material and improve transfer to the web. In one embodiment, a screen pattern of dots is burned into the flexographic plate or other printing surface. In one embodiment, the dots may have a diameter of 100 microns or less, more specifically 50 microns or less.

In addition to strengthening the web by printing a bonding material onto the web with a low-pressure printing process, the process of the present invention also includes softening the high bulk web without substantial loss of web bulk. In certain embodiments, the softening process may increase the web bulk. In general, the softening process includes subjecting the web to one or more low-pressure mechanical straining processes. Subjecting the web to low-pressure mechanical straining may improve the tactile properties of the web, including softness, while avoiding z-compaction of the web.

In one embodiment, the web may be mechanically strained by utilization of a microstraining process. In general, microstraining of a web includes any process in which a web may be significantly softened without significant loss of strength by passing the sheet through one or more nips in which relatively weak papermaking bonds within the sheet are broken while the stronger bonds are left intact. Breaking the weaker bonds within the sheet is manifested in a more open sheet structure which may be quantified by the increased measure of the percent void area exhibited in cross sections of the treated sheet. Unlike embossing and traditional creping processes, microstraining avoids z-direction compaction of the sheet. See, for example, U.S. Pat. No. 5,743,999 to Kamps, et al. which is herein incorporated by reference thereto as to all relevant material.

In one embodiment, a variation of flexographic printing may be applied in which the web is printed with bonding material at the same time as it is softened by being placed under microstraining forces within the printing nip. For example, the impression cylinder may be textured to approximate a reverse image of the plate cylinder, such that the web is strained at a microscopic level as the raised bonding material-bearing portions of the plate cylinder push the web into small depressions of the impression cylinder. In one sense, the flexographic plate on the plate cylinder and the impression cylinder could be considered interdigitating rolls. In such an embodiment, wherein the flexographic plate and the impression cylinder are both textured so as to microstrain the web, the hardness of both rolls as well as the texture of the rolls may be optimized for optimum printing and microstraining. For example, the Shore A hardness of either roll may exceed 40, 60, or 80 in such an embodiment. In addition, a combined printing and microstraining step may be followed or preceded by additional microstraining steps to achieve the desired tactile properties.

Figure 4:
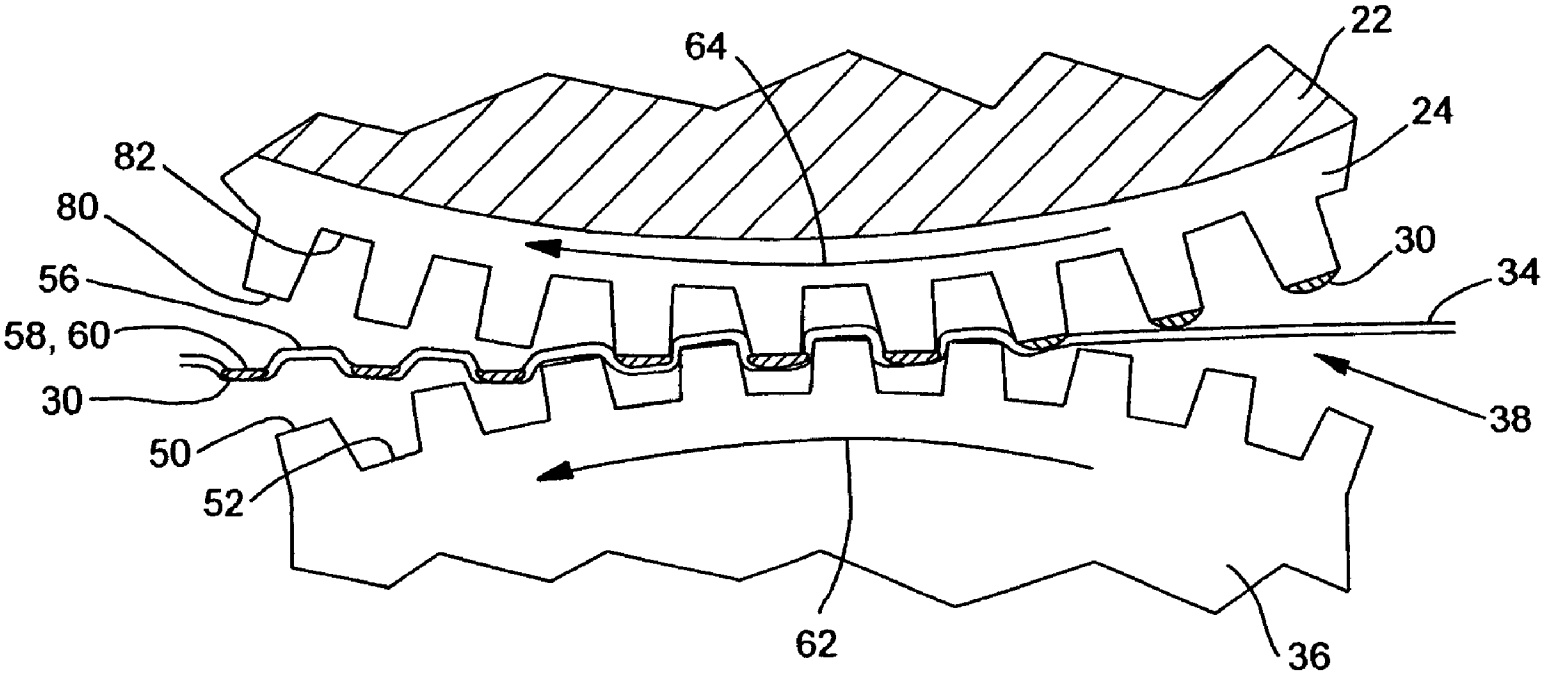
FIG. 4 depicts one embodiment of an interdigitating nip in a flexographic printing system.

FIG. 4 illustrates a nip 38 in which printing of a bonding material 30 and softening of a web 34 may occur simultaneously. The nip 38 is formed between the plate cylinder 22, covered with a flexographic plate 24, and an opposing impression cylinder 36 which has a textured surface with protrusions 50 and recessed portions 52 that interdigitate with the textured flexographic plate 24 which also has protrusions 80 and recessed portions 82. The protrusions 80 of the flexographic plate 24 may then be coated with the desired bonding material 30 which may be transferred in the nip 38 to the web 34 to form a network (not shown) of bonding material 30 in the depressed portions 58 of the web 34, while providing isolated elevated portions 56 of the web 34 that are substantially free of the bonding material 30. The pressures applied to the web in such an embodiment may be pressures which, while suitable to microstrain and soften the web according to the present invention, are low enough so as to not significantly deform the papermaking fibers in the web, such as peak pressure less than about 50 psi or less than about 5 psi.

Additionally, in those embodiments wherein the elevated portions 56 have a width on the order of the length of the fibers in the web 34, the bonding material 30 in the surrounding depressed portions 58 of the web 34 may provide additional stability to the elevated portions 56, by anchoring the ends of the fibers in the elevated portions 56 of the web 34 in place.

Figure 7A:
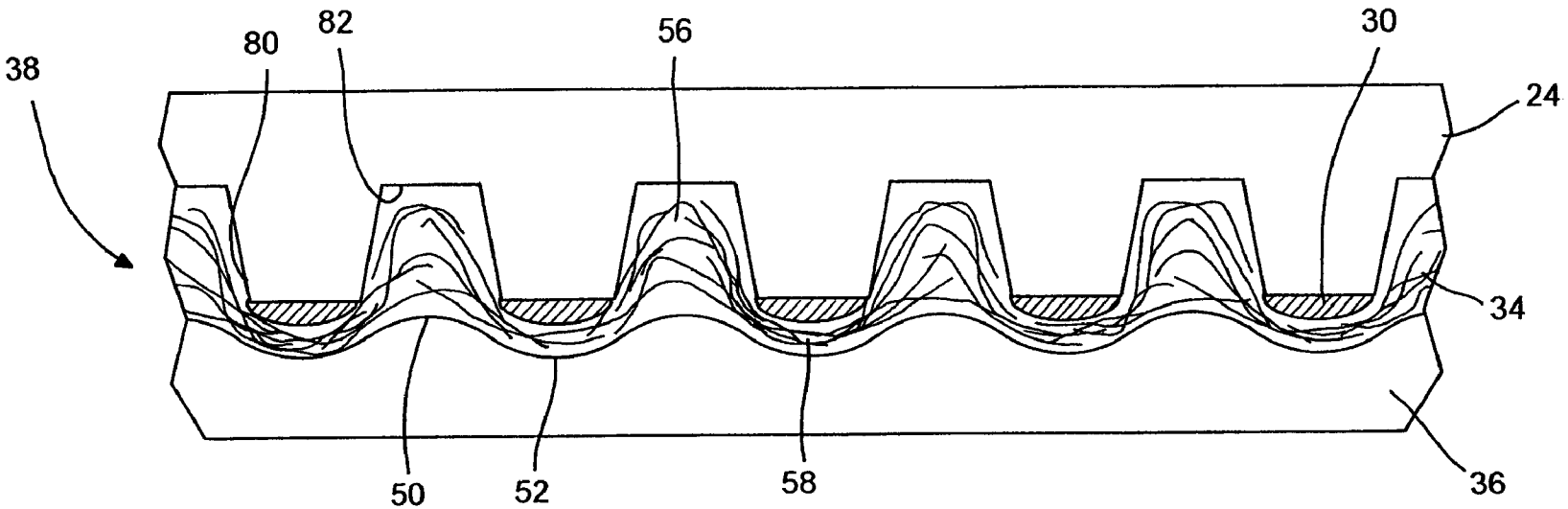
FIGS. 7A and 7B are schematics of embodiments of a nip formed between a flexographic plate and an impression cylinder.

In an alternative embodiment, the web may be softened and printed with the bonding material binder at the same time, but without an interdigitating impression cylinder as is used in the process illustrated in FIG. 4. For example, FIG. 7A illustrates a schematic showing a close-up of a nip 38 between a flexographic plate 24 and an elastomeric impression cylinder 36 which may be, for example, an elastomeric cover on a metal roll (not shown). The web 34 may be softened through application of microstraining forces by the alternating pattern of protrusions 80 and recessed portions 82 of the flexographic plate 24 as it presses the web 34 against the elastomeric cylinder 36, inducing a series of temporary protrusions 50 and recessed portions 52 in the elastomeric cylinder 36, resulting in the web 34 being microstrained at the depressed portions 58 and elevated portions 56. The depressed portions 58 of the web 34 are, in this case, relatively more compressed than the elevated portions 56 of the web 34. Bonding material 30 on the protrusions 80 of the flexographic plate 24 may come into contact with the web 34 in the nip 38, and may be transferred to the web 34. The added bonding material 30 may form a continuous network (not shown) of bonding material 30 in the depressed portions 58 of the web 34 which may surround and stabilize the elevated portions 56 of the web 34, thus locking in the three-dimensional structure of the web 34 that was imparted during softening in the nip 38.

In an alternative embodiment related to FIG. 7A, the impression cylinder 36 may be substantially rigid (e.g., metallic or hard rubber), such that it remains substantially flat in the nip.

Figure 7B:
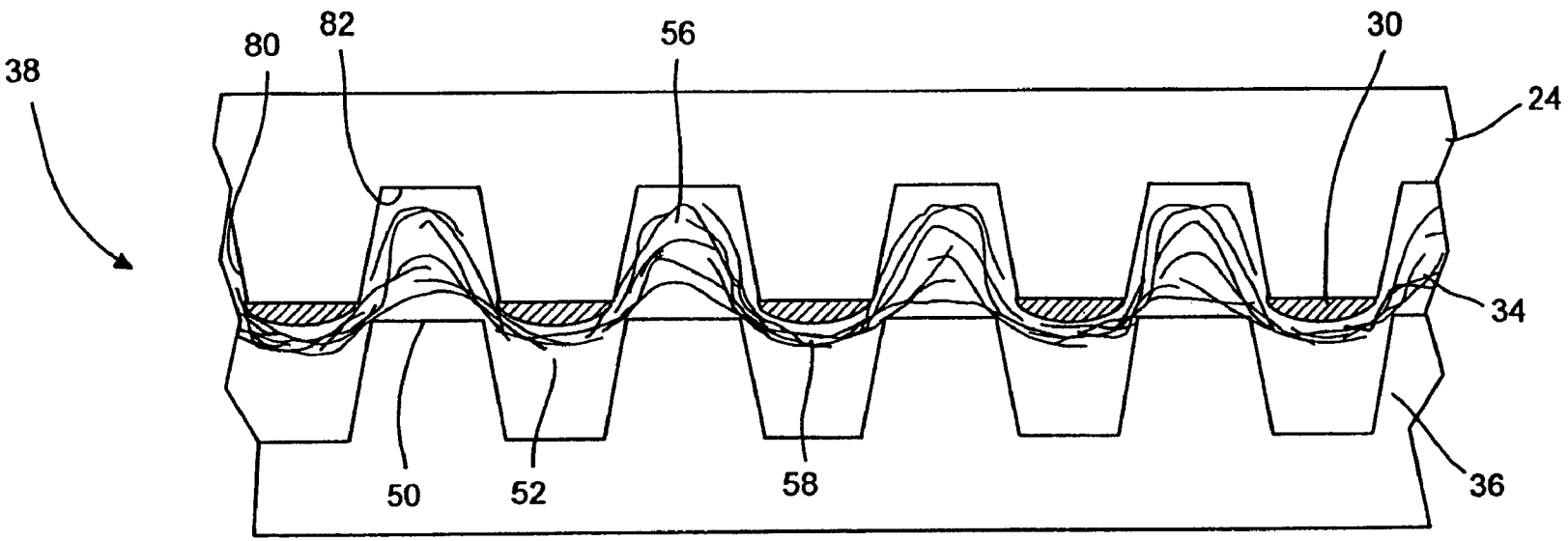

FIG. 7B shows an alternate embodiment of a nip 38 between a flexographic plate 24 and an impression cylinder 36 having a pattern corresponding to that of the flexographic plate 24, but skewed (offset) relative to the flexographic plate 24 such that the permanent protrusions 50 of the impression cylinder 36 are registered with the recessed portions 82 of the flexographic plate 24. The impression cylinder 36 may be rigid or deformable. In an alternative registered embodiment (not shown), the permanent protrusions 50 of the impression cylinder 36 may be registered with the protrusions 80 and of the flexographic plate 24 in the nip.

Additionally, if desired, the web may also be microstrained by brushing, calendering, ring-rolling, or Walton roll treatment to achieve the desired tactile properties. Such treatments may be applied before or after printing with bonding material. Rush transfer may also be used as a means of microstraining the web, wherein in-plane compressive stresses may cause buckling and internal delamination of the web. In one embodiment internal delamination may occur during rush transfer when one side of the web is moist and the other dry, such as immediately after printing one side of the web with a water-based ink or the bonding material of the present invention.

In another possible embodiment of the present invention, the web may be microstrained through used of an S-wrap technique. In this embodiment, the web may be passed over rollers with relatively small diameters to force the web to follow an S-shaped path, which may encourage differentials in tangential forces acting on either side of the web, effectively microstraining the web.

Another possible embodiment of the present invention may include microstraining the web through use of Walton roll treatment. A Walton roll refers to a pair of circumferentially grooved, mated rolls that deform a web passing through the nip formed by the rolls, and disclosed in U.S. Pat. No. 4,921,643 to Walton (herein incorporated by reference as to all relevant matter).

Another possible method of microstraining a web may be found in U.S. Pat. No. 5,562,645 to Tanzer, et al. (herein incorporated by reference as to all relevant matter). In which pulp rolls were microstrained by working the pulp sheet through a nip between pairs of counter-rotating engraved metal rolls which had been gapped to mechanically soften the sheet without cutting or tearing. Multiple passes may be used to produce a desired amount of sheet softening.

In one embodiment, the web may be softened by being subjected to a micro-creping process. In general, a microcreping process may be defined as a method in which the web is supported on the surface of a rotating drum and lengthwise compressed in a treatment cavity defined by the surfaces of the rotating drum, a primary blade which presses the web against the rotating drum, and an inclined rigid retarder blade which retards the forward movement of the web and dislodges the web from the surface of the rotating drum as described in U.S. Pat. No. 4,919,877, to Parsons, et al. which is herein incorporated by reference. As opposed to standard creping process, a microcreping process does not require the web to be pressed against the creping drum with an adhesive, thus, a microcreping process may be used to soften the web without densifying the web at a microscopic level, and thus may soften the high bulk web of the present invention without substantial loss of the web bulk.

In those embodiments wherein the web is softened by being subjected to a microcreping process after printing the bonding material onto the web, the bonding material should be allowed to cure prior to the microcreping process, in order that the web will not become adhesively secured to the creping drum and thus be undesirably densified in the softening process.

The processes of the present invention may be carried out online after a web has been dried, or may be offline at a converting facility, as desired. For example, an online paper making process may be modified to include printing and microstraining. In one embodiment of the present invention, a web may be formed, rush transferred, through-dried on a textured fabric, flexographically printed on one or both sides of the web with concurrent microstraining, then through dried to completion, microstrained again, wound and converted.

The final bulk after microstraining may be greater than the bulk of the web prior to printing or after printing but prior to microstraining. The ratio of final bulk to bulk in a previous state can be about 1.01 or greater, 1.05 or greater. 1.1 of greater, or about 1.2 or greater, such as from about 1.07 to about 2 or from about 1.1 to about 1.6. The act of printing can also increase the bulk of the web relative to the bulk prior to printing according to the same ratios set forth above for the bulk after microstraining. Printing can be especially effective in increasing the bulk of the web when the web is held in a three-dimensional state during printing ot after printing and prior to complete curing or drying of the bonding material, such that the bonding material helps to hold the web in a three-dimensional state offering higher bulk than was found in the original web.

The paper webs produced by the processes of the present invention may also be printed or otherwise coated with other materials, in addition to the bonding materials of the present invention. For example, any decorative elements known in the art may be additionally printed onto the base webs using a low pressure printing technology such as that of the present invention or alternatively may be applied by other low-pressure means such as, for example, spraying. Decorative printing may be applied within the scope of the present invention in conjunction with application of the bonding material, as is the case when the bonding material is colored and is applied in an aesthetically pleasing pattern. Decorative printing may optionally be applied in a separate step. In one embodiment, decorative pigments such as liquid crystal pigments may be applied to the webs of the present invention. For example, liquid crystal pigments may be applied to a dark substrate which may create colors that shift depending on the viewing angle ("color flops"). Helicone HC® pigments from Wacker-Chemie are an example of the materials that are used to create these effects. "Color flop" effects may be applied in this manner to any of the articles of the present invention.

Alternatively, any other additives, pigments, inks, emollients, pharmaceuticals or other skin wellness agents or the like described herein or known in the art may be applied to the web of the present invention, either uniformly or heterogeneously. For example, either surface of the web may be printed with an additive according to the present invention, have an additive sprayed substantially uniformly, or have an additive selectively deposited on all or a portion of the web such that the web is not substantially densified by addition of the additive. Skin wellness agents may include, for example, any known skin wellness agents such as, but not limited to, anti-inflammatory compounds, lipids, inorganic anions and cations, protease inhibitors, sequestration agents, antifungal agents, antibacterial agents, acne medications, and the like.

The paper webs of the present invention may be used in many forms, including multilayered structures, composite assemblies, and the like such as two or more tissue plies that have joined together, for example, joined by hotmelt adhesives, latex, curable adhesives, thermally fused binder particles or fibers, and the like. The plies may be substantially similar or dissimilar. Dissimilar plies may include the strong, soft web of the present invention joined to an airlaid, a nonwoven web, an apertured film, an uncreped tissue web, a tissue web of differing color, basis weight, chemical composition (differing chemical additives), fiber composition, or differing due to the presence of embossments, apertures, printing, softness additives, abrasive additives, fillers, odor control agents, antimicrobials, and the like. The web may also be used as a basesheet, such as in construction of wet wipes, paper towels, and other articles.

The tissue web may comprise synthetic fibers or other additives. However, in one embodiment, the web has less than 20% by weight of synthetic polymeric material prior to processing, more specifically less than 10% by weight of synthetic polymeric material.

In one embodiment, the paper webs of the present invention may be laminated with additional plies of tissue or layers of nonwoven materials such as spunbond or meltblown webs, or other synthetic or natural materials. This could be done before or after processing according to the present invention. For example, in a cellulosic product containing two or more plies of tissue, such as bath tissue, a pair of plies such as the plies forming the opposing outer surfaces of the product may comprise any of the following: a creped and uncreped web; a calendered and uncalendered web; a web comprising hydrophobic matter or sizing agents and a more hydrophobic web; webs of two differing basis weights; webs of two differing embossment patterns; an embossed and unembossed web; a web with high wet strength and a web with low wet strength; a web having syncline marks and a web free of syncline marks; a web with antimicrobial additives and a web free of such additives; a web with asymmetrical domes and one free of domes; a through-dried web and a web dried without use of a through-dryer; webs of two different colors; an apertured web and an unapertured web; and the like. Lamination may be achieved through crimping, perf-embossing, bonding material attachment, etc.

The tissue webs of the present invention may be provided as single ply webs, either alone or in combination with other absorbent material. In another embodiment, two or more webs of the present invention may be plied together to make a multi-ply structure. If bonding material is printed on only one side of the web, the multi-ply article may have the adhesive-printed sides facing the outside of the multi-ply article or turned toward the inside of the article, such that the unprinted sides face out, or may have one printed side of a web facing out on one surface of the article and an unprinted side facing out on the opposing surface of the article.

The products made from the webs of the present invention may be in roll form with or without a separate core, or may be in a substantially planar form such as a stack of facial tissues, or in any other form known in the art. Products intended for retail distribution or for sales to consumers will generally be provided in a package, typically comprising plastic (e.g., flexible film or a rigid plastic carton) or paperboard, having printed indicia displaying product data and other consumer information useful for retail sales. The product may also be sold in a package coupled with other useful items such as lotions or creams for skin wellness, pharmaceutical or antimicrobial agents for topical application, diaper rash treatments, perfumes and powders, odor control agents such as liquid solutions of cyclodextrin and other additives in a spray bottle, sponges or mop heads for cleaning with disposable high wet strength paper, and the like.

In another embodiment, the webs of the present invention may be used to produce wet wipes such as premoistened bath tissue. For good dispersibility and good wet strength, bonding materials that are sensitive to ion concentration may be used such that the bonding material provides integrity in a wetting solution that is high in ion concentration, but loses strength when placed in ordinary tap water because of a lower ion strength.

The webs of the present invention may be subsequently treated in any way known in the art. The web may be provided with particles or pigments such as super absorbent particles, mineral fillers, pharmaceutical substances, odor control agents, and the like, by methods such as coating with a slurry, electrostatic adhesion, bonding material attachment, by application of particles to the web or to the elevated or depressed regions of the web, for example such as application of fine particulates by an ion blast technique and the like. The web may also be calendered, embossed, slit, rewet, moistened for use as a wet wipe, impregnated with thermoplastic material or resins, treated with hydrophobic matter, printed, apertured, perforated, converted to multiply assemblies, or converted to bath tissue, facial tissue, paper towels, wipers, absorbent articles, and the like.

The tissue products of the present invention may be converted in any known tissue product suitable for consumer use. Converting may comprise low-pressure calendering, slitting, printing, addition of perfume, addition of lotion or emollients or health care additives such as menthol, stacking preferably cut sheets for placement in a carton or production of rolls of finished product, and final packaging of the product, including wrapping with a poly film with suitable graphics printed thereon, or incorporation into other product forms.

Reference now will be made to various embodiments of the invention, one or more examples of which are set forth below. Each example is provided by way of explanation of the invention, not as a limitation of the invention. In fact, it will be apparent to those skilled in the art that various modifications and variations may be made of this invention without departing from the scope or spirit of the invention.

EXAMPLE 1

A high bulk, resilient, three-dimensional uncreped through-dried web was printed flexographically with hot melt bonding material using the heated flexographic printing equipment of Propheteer International (Lake Zurich, Ill.). The Propheteer 2000 3-Color line was used, comprising an unwind unit, a UV curing station, a flexographic hot melt applicator, a rewind unit, a sheeting station and a stacker. The flexographic applicator was a Flexo Hot Melt Applications Processor manufactured by GRE Engineering Products AG in Steinebrunn, Switzerland (believed to be GRE model HM 220-500). It was adapted to process sheets up to 20 inches wide. The flexographic plate comprised a high-temperature silicone elastomer having a maximum application temperature of 500° F. based on polydimethylsiloxane produced by the Chase Elastomer Division of PolyOne Corporation (Kennedale, Tex.). The Propheteer system further comprises a Flexo UV Silicone Applicator in a Propheteer Label Printing Press, though UV-curing of silicone was not included in these trials.

In one series of runs, the Flexo Hot Melt Applications Processor was used to apply the hotmelt Epolene® C-10, a polyethylene-based Epolene® wax hotmelt manufactured by the Texas Eastman Division of Eastman Chemical (Longview, Tex.). This hotmelt is reported by the manufacturer to have a Brookfield viscosity at 150° C. of 7800, according to Test Method TEX-542-111 of the Texas Eastman Division. Further, Epolene® C-10 is reported to have a density at 25° C. or 0.906 g/ml, a softening point (Ring and Ball Softening Point) of 104° C., a Melt Index at 190° C. of 2250, a weight-averaged molecular weight of 35,000 and a number-averaged molecular weight of 7,700, and a cloud point of 77° C. (for a 2% solution in paraffin at 130° C.). Epolene® waxes are reported to have softening points of 100° C. to 163° C. (Without limitation, useful hot melts may have softening points equal to or greater than any integral temperature value between 90° C. and 250° C.)

In another series of runs, the hotmelt was HM-0727, one of the series of Advantra™ hot melts manufactured by H.B. Fuller Company, St. Paul, Minn.

The cylinder base of the flexographic cylinder was manufactured by Action Rotary Die, Inc. (Addison, Ill.), and the rubber plate on the cylinder was produced by Schawk, Inc. (Des Plaines, Ill.). The rubber plate is vulcanized and laser engraved by Schawk, Inc.

A hotmelt was printed onto an uncreped web with a flexographic plate have an engraved pattern similar to that of FIG. 5.

The uncreped web was formed in a similar method to that disclosed in Example 1 of U.S. Pat. No. 6,395,957 to Chen, et al. (herein incorporated by reference as to all relevant matter). The base sheet was produced on a continuous tissue-making machine adapted for uncreped through-air drying, similar to the machine configuration shown in FIG. 4 of Chen, et al. The machine comprised a Fourdrinier forming section, a transfer section, a through-drying section, a subsequent transfer section and a reel.

The process included a three-layered headbox to form a web with three layers. The two outer layers in the three-layered headbox comprised dilute pulp slurry (about 1% consistency) made from LL19 pulp, a southern softwood bleached kraft pulp of Kimberly-Clark Corp., (Dallas, Tex.). The central layer was made from a 50/50 mix of LL19 pulp and bleached chemithermomechanical pulp (BCTMP), pulped for 45 minutes at about 4% consistency prior to dilution. The BCTMP is commercially available as Millar-Western 500/80/00 (Millar-Western, Meadow Lake, Saskatchewan, Canada). The mass split of the layered web, based on fiber throughput to the layered sections of the headbox, as 25% for both of the outer layers and 50% for the inner layer, in a web with a basis weight if 52 grams per square meter (gsm).

No wet strength agents or starches were added to the web. A debonder was added to the slurry forming the two outer layers as well as to the slurry forming the central layer. The debonder was a quaternary ammonium compound, ProSoft TQ1003 made by Hercules, Inc. (Wilmington, Del.) added at a dose of 5 kg/per ton of dry fiber. The slurry was then deposited on a fine forming fabric and dewatered by vacuum boxes to form a web with a consistency of about 12%. The web was then transferred to a transfer fabric using a vacuum shoe at a first transfer point with no significant speed differential between the two fabrics. The web was further transferred from the transfer fabric to a woven through-drying fabric at a second transfer point using a second vacuum shoe. The through drying fabric used was a Lindsay Wire T-1203-1 design (Lindsay Wire Division, Appleton Mills, Appleton, Wis.), based on the teachings of U.S. Pat. No. 5,429,686 issued to Chiu et al., herein incorporated by reference. The T-1203-1 fabric is well suited for creating molded, three-dimensional structures. At the second transfer point, the through-drying fabric was traveling more slowly than the transfer fabric, with a velocity differential of 45% (45% rush transfer) such that the web was subjected to low-pressure softening forces. The web was then passed into a hooded through dryer where the sheet was dried. The dried sheet was then transferred from the through-drying fabric to another fabric, from which the sheet was reeled. The sheet had a thickness of about 1 mm (44.2 mils), a geometric mean tensile strength of about 665 grams per 3 inches (measured with a 4-inch jaw span and a 10-inch-per minute crosshead speed at 50% relative humidity and 22.8° C.), An MD:CD tensile strength ratio of 1.07; 9.9% CD stretch.

A roll of the uncreped web was placed in the unwind stand of the Propheteer 2000 3-Color line described in Example 1. The flexographic gap was adjusted to accommodate the basesheet (thickness about 1 mm) without significant densification of the web. Printing with the HM-0727 bonding material and the Epolene™ C-10 wax yielded results in which the applied hotmelt did not closely match the intended pattern. There appeared to be a degree of bleeding and there were numerous fibrous hotmelt threads on the surface. This distribution of hotmelt is not necessarily undesirable. But in order to achieve a crisper application of hotmelt more closely corresponding to the flexographic print pattern, the pattern was made less fine by removing the dots and circles in the pattern of FIG. 5. The removal of the dots and circles inside the hexagons on the flexographic plate was achieved by using a hand drill, repeatedly drilling away the elevated structures inside the hexagons of a section of the roll. The modified portion of the flexographic plate gave significantly improved definition in the printed pattern. Definition was checked by adding a blue pigment to the hotmelt to more clearly observe its location in the web.

EXAMPLE 2

To demonstrate flexographic printing of a synthetic latex emulsion, runs were conducted on a Kimberly-Clark pilot printing facility in Neenah, Wis. A four-roll flexographic system, substantially as shown in FIG. 10, was used, but typically with bonding material applied on one side only. The flexographic system was manufactured by Retroflex, Inc. of Wrightstown, Wis. Flexographic plates were prepared with the three patterns shown in FIGS. 11A-11C.

A roll of the unprinted, uncreped through-air dried tissue made according to Example 1 was positioned in an unwind stand from which it was guided through the flexographic press. The flexographic printer was configured for single side application with a gap offset of 0.003" inch. Printed latex was dried as the web passed through an infrared oven set at 380° F. (not shown in FIG. 10). The web with the dried latex was then wound into a roll. The unwind, flexographic printing system, oven drying and curing and rewind units were synchronized for matched web surface speed. The flexographic pattern printer applied the latex print medium to the basesheet.

Calibration of the pattern printing plate gap relative to the backing roll was conducted for uniform fluid application to the basesheet. The gap was measured as being 0.0085" inch, and raw caliper (the thickness of the web entering the nip) was 32.2 mils as measured with the previously described Starrett™ Model No. 1010 hand micrometer from L. S. Starrett Company (Athol, Mass.). Raw calipers from 11.0 to 48.6 were possible with the system. The flexographic print system allows flexible durable print contact with minimum impression pressure, such as about 0.25 pli or less. The nip width (machine direction length of contact in the nip) was approximately 0.25 inches, uniformly observed across the width of the machine. Nip widths may exceed 0.75 inches depending on the Durometer value of the pattern plate material used or impression pressure.

The latex applied was AirFlex™ EN1165 latex, manufactured by Air Products (Allentown, Pa.). Following application of latex, printed tissue was cured at 300° F. in an Emerson Speed Dryer Model 130 (Emerson Apparatus, Portland, Me.). Curing at elevated temperature was needed because the latex was used without catalyst.

Latex was applied at solids levels of 25%, 30%, 35% 40%, 45% and 50% though solids levels from about 3-5% up to 100% could be applied. Add-on levels for the uncreped basesheet were generally 5% to 10%, with about 7% being typical.

A normal backing roll consists of a 100% surface smooth steel to fully support the pattern graphic impression onto the basesheet. In duplex printing, each pattern roll relies on the opposing roll for support to print the basesheet. In each series of runs, the pattern print plates used the print pattern of FIG. 11B which provided 41.16% graphic coverage, (41.16% of the plate surface area is occupied by elevated printing areas), so approximately 59% of the pattern print plate was non-print areas or voids. In this pattern, the width of hexagonal cells from one side to the opposing parallel side was 3.8 mm and the line width was 96.5 microns. Both pattern print plates were run with non-registered alignment of back-to-back patterns. (Registered back-to-back pattern print plates are another setup using a matched alignment and gaining 100% backing support for a total impression of the pattern print plate.) Latex was applied to the tissue web under a variety of run conditions with the duplex printing system.

Figure 11A:
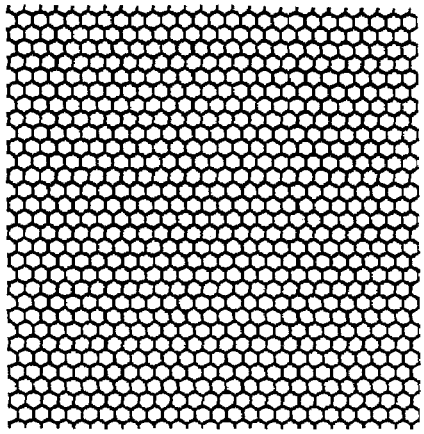
FIGS. 11A, 11B, and 11C depict patterns used in flexographic printing of a tissue web.

In one series of runs, latex at 35% solids was applied with the control pattern of FIG. 11A. Run conditions were conducted by altering the gap width, with higher gap width resulting in lower applied pressure and apparently causing less penetration of the bonding material into the tissue web. Tensile strength results are shown in the table given in FIG. 12, where significant gains in tensile strength and stretch are observed when the gap was reduced to 0.002 inches or 0.004 inches. The reported caliper is for a single sheet measured with an Emveco Model 200A Electronic Microgage (EMVECO Inc., Newberg, Oreg.), operating with an applied load of 0.289 psi and a 2.22-inch diameter platen. Tensile strength was measured with a 4-inch gauge length, a 3-inch width, and a crosshead speed of 10 inches per minute.

Figure 11B:
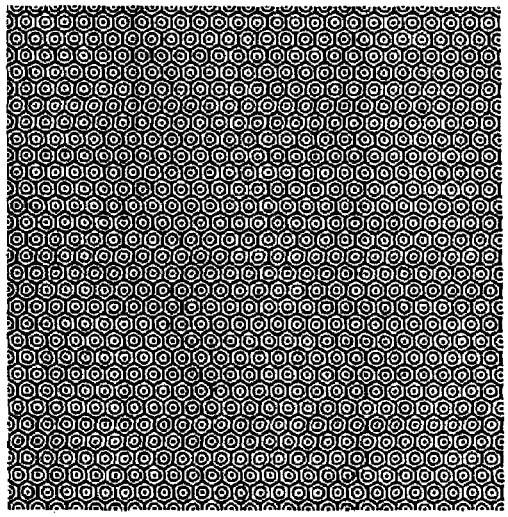
Figure 11C:
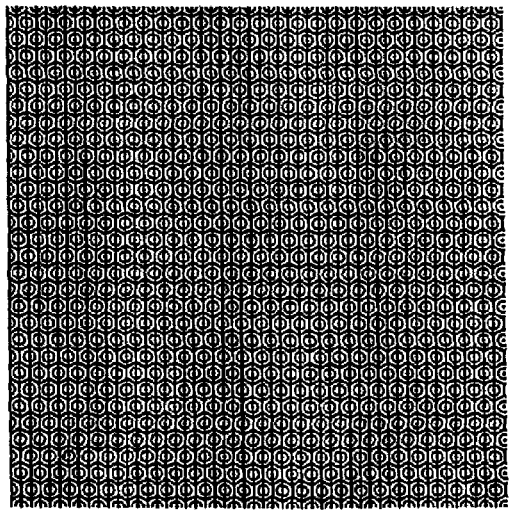

In another series of runs, several latex solids levels were used and all three printing patterns in FIGS. 11A-11C were used to create the runs listed in Table 2. The physical properties of the resulting latex-printed tissue are given in Table 3.

TABLE 2

Conditions for Runs with Various Flexographic Patterns

| Run | Flexographic Pattern | Screen Density | Latex Solids |
|---|---|---|---|
| Run 1 | FIG. 14A | 100% | 35% |
| Run 2 | FIG. 14A | 100% | 45% |
| Run 3 | FIG. 14A | 90% | 45% |
| Run 4 | FIG. 14A | 90% | 35% |
| Run 5 | FIG. 14B | 90% | 35% |
| Run 6 | FIG. 14B | 90% | 45% |
| Run 7 | FIG. 14C | 100% | 45% |
| Run 8 | FIG. 14C | 100% | 35% |

TABLE 3

Measured Properties for the Runs of Table 2

| Run | Caliper (mils) | Caliper Retention | MD Tensile (grams) | CD Tensile (grams) | Cured Wet CD (grams) | Wet/ Dry | GMT | MD/CD |
|---|---|---|---|---|---|---|---|---|
| Base-sheet | 27.5 | NA | 670 | 503 | — | — | 581 | 1.33 |
| Run 1 | 19.7 | 71.6% | 1320 | 821 | 236 | 28.7% | 1041 | 1.61 |
| Run 2 | 22 | 80.0% | 1511 | 1076 | 325 | 30.2% | 1275 | 1.40 |
| Run 3 | 20.2 | 73.5% | 1245 | 1006 | 313 | 31.2% | 1119 | 1.24 |
| Run 4 | 22.8 | 82.9% | 1413 | 1071 | 312 | 29.2% | 1230 | 1.32 |
| Run 5 | 22 | 80.0% | 1471 | 1133 | 369 | 32.6% | 1291 | 1.30 |
| Run 6 | 22.3 | 81.1% | 1599 | 1226 | 482 | 39.4% | 1400 | 1.30 |
| Run 7 | 22.4 | 81.5% | 1453 | 1113 | 419 | 37.7% | 1272 | 1.31 |
| Run 8 | 20.5 | 74.5% | 1781 | 1305 | 486 | 37.3% | 1524 | 1.37 |

Printing the high bulk web with latex resulted in significant increases in wet and dry tensile strength. The printing process resulted in some loss in bulk, with roughly 80% of the caliper of the web being retained (about 20% of the bulk was lost). Without wishing to be bound by theory, it is believed the use of a water-containing bonding material such as latex may result in some collapse of a dry bulky web, particularly when the web is compressed during or after printing, unless further steps are taken to increase or preserve bulk, such as applying bonding material to the web and at least particularly drying or curing the web as it is held in a three-dimensional, textured configuration to impart added bulk to the web maintained by the bonding material. Larger print gaps and/or more resilient basesheets may have also resulted in greater caliper retention.

It will be appreciated that the foregoing examples, given for purposes of illustration, are not to be construed as limiting the scope of this invention. Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention which is defined in the following claims and all equivalents thereto. Further, it is recognized that many embodiments may be conceived that do not achieve all of the advantages of some embodiments, yet the absence of a particular advantage shall not be construed to necessarily mean that such an embodiment is outside the scope of the present invention.

What is claimed is:

1. A process for forming a paper product comprising:

providing a paper web comprising paper making fibers, said paper web having a first side and a second side, wherein said paper web is dry such that the web has about 92% solids or greater;

printing a bonding material on the first side of the web in a first pattern by use of a low pressure printing process;

curing the bonding material;

softening the web by use of a mechanical straining process which avoids z-direction compaction of the web, wherein the web bulk is increased or decreased by the mechanical straining process, wherein when the web bulk is decreased by the mechanical straining process, the web bulk is decreased by less than about 20% by the mechanical straining process; and wherein the paper product is uncreped.

2. The process of claim 1, wherein the paper web is an uncreped, through-dried paper web.

3. The process of claim 1, wherein the paper web provided to the process has a bulk greater than about 10 cc/g.

4. The process of claim 1, wherein the paper web provided to the process has a bulk between about 10 cc/g and about 20 cc/g.

5. The process of claim 1, wherein the printing process is selected from the group consisting of flexographic printing, inkjet printing, and digital printing processes.

6. The process of claim 1, wherein the printing process is a flexographic printing process.

7. The process of claim 6, wherein the flexographic printing process comprises guiding the web through a printing nip comprising interdigitating rolls.

8. The process of claim 7, wherein the web is mechanically strained in the printing nip.

9. The process of claim 1, wherein the bonding material has a Brookfield viscosity at 20 rpm of about 20 poise or greater.

10. The process of claim 1, wherein the bonding material has a Brookfield viscosity at 20 rpm of about 500 poise or greater.

11. The process of claim 1, wherein the bonding material is a hot melt bonding material and has a viscosity of about 1000 centipoise or greater when it is printed on the paper web.

12. The process of claim 1, wherein the bonding material is added to the web at a peak pressure on the web of less than about 100 psi.

13. The process of claim 1, wherein the bonding material is added to the web at a peak pressure on the web of between about 0.2 and about 30 psi.

14. The process of claim 1, wherein the first pattern is essentially continuous across the first side of the paper web.

15. The process of claim 1, further comprising adding a bonding material to the second side of the web in a second pattern by use of a low pressure printing process.

16. The process of claim 15, wherein the first pattern and the second pattern are the same.

17. The process of claim 15, wherein the first pattern and the second pattern are different.

18. The process of claim 1, further comprising adding an additive on a surface of the web by a low-pressure addition process.

19. The process of claim 1, wherein the web is mechanically strained by a process selected from the group consisting of microstraining, microcreping, rush transfer, brushing, and ring rolling.

20. The process of claim 1, wherein the web is mechanically strained by a microcreping process.

21. The process of claim 1, wherein the bonding material is added to the web prior to the web being softened.

22. The process of claim 1, wherein the web is softened prior to the addition of the bonding material.

23. The process of claim 1, wherein the paper web is a molded web.

24. The process of claim 1, wherein the printing and softening processes together decrease the bulk of the paper web by no more than 30% of the initial bulk of the paper web provided to the process.

25. The process of claim 1, wherein the paper web comprises two or more plies.

26. The process of claim 25, wherein the plies are dissimilar.

27. The process of claim 1, wherein the bonding material is cured by a process selected from the group consisting of cooling the bonding material, waiting for a curing reaction to occur without heating the bonding material, heating the bonding material, applying radiation to the bonding material, applying a chemical agent to the bonding material, and drying the bonding material.

28. The process of claim 1, wherein the web bulk is increased during the printing process.

29. The process of claim 28, wherein the web bulk following the printing process is at least about 1.01 times the web bulk immediately prior to the printing process.

30. The process of claim 28, wherein the web bulk following the printing process is at least about 1.05 times greater than the web bulk immediately prior to the printing process.

31. The process of claim 28, wherein the web bulk following the printing process is at least about 1.1 times greater than the web bulk immediately prior to the printing process.

32. The process of claim 28, wherein the web bulk following the printing process is at least about 1.2 times greater than the web bulk immediately prior to the printing process.

33. The process of claim 1, wherein the web bulk following the mechanical straining process is at least about 1.01 times the web bulk immediately prior to the mechanical straining process.

34. The process of claim 1, wherein the web bulk following the mechanical straining process is at least about 1.05 times greater than the web bulk immediately prior to the mechanical straining process.

35. The process of claim 1, wherein the web bulk following the mechanical straining process is at least about 1.1 times greater than the web bulk immediately prior to the mechanical straining process.

36. The process of claim 1, wherein the web bulk following the mechanical straining process is at least about 1.2 times greater than the web bulk immediately prior to the mechanical straining process.

37. The process of claim 1, wherein the softened and printed paper web has a web bulk at least about 1.01 times greater than the unprocessed paper web provided to the process.

38. The process of claim 37, wherein the softened and printed paper web has a web bulk at least about 1.05 times greater than the unprocessed paper web provided to the process.

39. The process of claim 37, wherein the softened and printed paper web has a web bulk at least about 1.1 times greater than the unprocessed paper web provided to the process.

40. The process of claim 37, wherein the softened and printed paper web has a web bulk at least about 1.2 times greater than the unprocessed paper web provided to the process.

41. A process for forming a paper web comprising:

providing an uncreped, through-dried paper web comprising paper making fibers, said paper web having a first side and a second side;

flexographically printing a bonding material to the first side of the web by use of a low pressure printing process;

mechanically straining the web which avoids z-direction compaction of the web, wherein the web bulk is increased or decreased by the mechanical straining, wherein when the web bulk is decreased by the mechanical straining, the web bulk is decreased by less than about 20% by the mechanical straining; and wherein the paper web formed from the process is uncreped.

42. The process of claim 41, wherein the paper web has a bulk of at least about 10 cc/g.

43. The process of claim 41, wherein the paper web has a bulk between about 10 cc/g and about 20 cc/g.

44. The process of claim 41, wherein the flexographic printing process comprises guiding the web through a printing nip comprising interdigitating rolls.

45. The process of claim 44, wherein the web is mechanically strained in the printing nip.

46. The process of claim 41, wherein the bonding material has a Brookfield viscosity at 20 rpm of about 20 poise or greater.

47. The process of claim 41, wherein the bonding material is a hot melt bonding material and has a viscosity of about 1000 centipoise or greater when it is printing on the web.

48. The process of claim 41, wherein the bonding material is printed onto the web at a peak pressure of less than about 100 psi.

49. The process of claim 41, wherein the bonding material is printed onto the web at a peak pressure of between about 0.2 and about 30 psi.

50. The process of claim 41, further comprising flexographically printing a bonding material to the second side of the web in a second pattern.

51. The process of claim 50, wherein the first pattern and the second pattern are the same.

52. The process of claim 50, wherein the first pattern and the second pattern are staggered and the bonding material is printed onto both sides of the web in a single printing nip.

53. The process of claim 50, wherein the first pattern and the second pattern are different.

54. The process of claim 41, further comprising adding an additive on a surface of the web by a low-pressure addition method.

55. The process of claim 41, wherein the web is mechanically strained by a process selected from the group consisting of microstraining, microcreping, rush transfer, brushing, and ring rolling.

56. The process of claim 41, wherein the web is mechanically strained by a microcreping process.

57. The process of claim 41, wherein the bonding material is printed onto the web prior to the web being mechanically strained.

58. The process of claim 41, further comprising curing the bonding material prior to the web being mechanically strained.

59. The process of claim 41, wherein the web is mechanically strained prior to the bonding material being printed onto the web.

60. The process of claim 41, wherein the web is a stratified web.

61. The process of claim 41, further comprising molding the web.

62. The process of claim 41, wherein the printing and mechanical straining processes together decrease the bulk of the paper web by no more than 30% of the initial bulk of the paper web provided to the process.

63. The process of claim 41, wherein the paper web comprises two or more plies.

64. The process of claim 63, wherein the plies are dissimilar.

65. The process of claim 41, wherein the bonding material penetrates below the first surface of the web.

* * * * *